US006777868B1

(12) United States Patent
Kosaka et al.

(10) Patent No.: US 6,777,868 B1
(45) Date of Patent: Aug. 17, 2004

(54) ELECTRIFICATION MODERATING FILM, ELECTRON BEAM SYSTEM, IMAGE FORMING SYSTEM, MEMBER WITH THE ELECTRIFICATION MODERATING FILM, AND MANUFACTURING METHOD OF IMAGE FORMING SYSTEM

(75) Inventors: Yoko Kosaka, Atsugi (JP); Noriaki Ohguri, Zama (JP); Yoshimasa Okamura, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/343,226

(22) Filed: Jun. 30, 1999

(30) Foreign Application Priority Data

| | | |
|---|---|---|
| Jul. 2, 1998 | (JP) | 10-187918 |
| Sep. 14, 1998 | (JP) | 10-260507 |
| Oct. 22, 1998 | (JP) | 10-301203 |
| Jun. 29, 1999 | (JP) | 11-183867 |

(51) Int. Cl.[7] ..... H01J 1/62
(52) U.S. Cl. ..... 313/495; 313/292
(58) Field of Search ..... 313/495, 496, 313/497, 422, 479, 292, 283

(56) References Cited

U.S. PATENT DOCUMENTS

| | | | | |
|---|---|---|---|---|
| 4,769,575 | A | 9/1988 | Murata et al. | 313/495 |
| 4,895,789 | A | 1/1990 | Motte et al. | 430/316 |
| 5,690,530 | A | 11/1997 | Jin et al. | 445/24 |
| 5,760,538 | A | 6/1998 | Mitsutake et al. | 313/422 |
| 6,144,154 | A | 11/2000 | Yamazaki et al. | 313/495 |
| 6,274,972 | B1 | 8/2001 | Mitsutake et al. | 313/292 |

FOREIGN PATENT DOCUMENTS

| | | |
|---|---|---|
| EP | 0 306 338 | 3/1989 |
| EP | 0 690 472 | 1/1996 |

(List continued on next page.)

OTHER PUBLICATIONS

H. Araki et al., "Electroforming and Electron Emission of Carbon Thin Films," J. Vacuum Soc. Jap., vol. 26, No. 1 (1981) pp. 22–29, no month.

G. Dittmer, "Electrical Conduction and Electron Emission of Discontinuous Thin Films," Thin Solid Films, vol. 9, (1972) pp. 317–328, no month.

W.P. Dyke et al., "Field Emission," Adv. Electronics and Electron Physics, vol. VIII (1956) pp. 89–185, no month.

M. Elinson et al., "The Emission of Hot Electrons and the Field Emission of Electrons from Tin Oxide," Radio Eng. Electronic Phys. (1965) pp. 1290–1296, no month.

M. Hartwell et al., "Strong Electron Emission from Patterned Tin–Indium Oxide Thin Films," Int'l. Electron Dev. Meeting Tech. Dig. (1975) pp. 519–521, no month.

Y. Kudryavtsev et al., "Influence of Annealing on the Electrical Resistance and Structure of Amorphous Chromium Germanide Films," Inorganic Materials, vol. 15, No. 2 (1979) pp. 173–176 (XP–002122038), no month.

C.A. Mead, "Operation of Tunnel–Emission Devices," J. Appl. Phys., vol. 32, No. 4 (1961) pp. 646–652, no month.

C. Spindt et al., "Physical Properties of Thin–Film Field Emission Cathodes with Molybdenum Cones," J. Appl. Phys., vol. 47, No. 12 (1976) pp. 5248–5263, no month.

*Primary Examiner*—Vip Patel
*Assistant Examiner*—Joseph Williams
(74) *Attorney, Agent, or Firm*—Fitzpatrick, Cella, Harper & Scinto

(57) ABSTRACT

The present invention discloses a film comprising at least a compound of germanium as a film structure capable of suppressing influence of electrification. It also discloses an electron beam system, particularly an image forming system, using a member having the film comprising at least a compound of germanium. It further discloses a manufacturing method of the image forming system.

48 Claims, 14 Drawing Sheets

FOREIGN PATENT DOCUMENTS

| | | |
|---|---|---|
| JP | 57-118355 | 7/1982 |
| JP | 61-124031 | 6/1986 |
| JP | 61-124032 | 6/1986 |
| JP | 61-194823 | 8/1986 |
| JP | 62-061056 | 3/1987 |
| JP | 01-119103 | 5/1989 |
| JP | 8-180821 | 7/1996 |
| JP | 8-508846 | 9/1996 |
| JP | 10-302633 | 11/1998 |
| KR | 96-2448 | 1/1996 |
| KR | 98080945 | 11/1998 |
| WO | WO 94/18694 | 8/1994 |
| WO | 96 02933 | 2/1996 |

ELECTRIFICATION MODERATING FILM, ELECTRON BEAM SYSTEM, IMAGE FORMING SYSTEM, MEMBER WITH THE ELECTRIFICATION MODERATING FILM, AND MANUFACTURING METHOD OF IMAGE FORMING SYSTEM

BACKGROUND OF THE INVENTION

1. Field of the Invention

An invention set forth in this application relates to a film capable of moderating electrification. An invention set forth in this application relates in particular to a film capable of moderating influences due to electrification which may be produced by bombardment of electrons. An invention set forth in this application relates to an electron beam system. An invention set forth in this application relates to member which is used in the electron beam system, An invention set forth in this application relates to an image forming system. Furthermore, an invention set forth in this application relates to methods to manufacture the film, systems and the member.

2. Related Background Art

Planar surface type displays which have small depths, occupy small spaces, and are light in weights thereof are attracting attentions as substitutes for cathode-ray tube type displays. Under the present circumstances, the planar surface type displays are classified into a liquid crystal type, plasma luminescence type and display using multiple electron sources. The plasma luminescence type and multi-electron source type displays have large angles of view and are capable of displaying images of qualities as high as those displayed by the cathode-ray tube type displays.

A display which uses a large number of fine electron sources is schematically shown in FIG. 14, wherein a reference numeral 51 represents an electron source which is disposed on a rear plate 52 made of glass and a reference numeral 54 designates a face plate which is made of glass coated with a fluorescent substance. There have been developed for electron sources, a field-emission type electron emission element which can be integrated at a high density and emit electrons from a conical or needle-like tip and a cold-cathode ray tube type electron emission element such as a surface conductive type electron emission element. A wiring to drive the electron source is omitted in FIG. 14. In order to prevent a substrate from being deformed due to a difference between internal vacuum and an external atmospheric pressure as the display has a larger display area, it is necessary to thicken the rear plate and the face plate. However, the rear plate and the face plate which are thick not only increase a weight of the display but also allow an image to be distorted when it is seen obliquely. Accordingly, a spacer or a structure support which is referred to as a rib is used between the rear plate and the face plate so that the display is bearable of the atmospheric pressure with relatively thin glass plates. The rear plate on which the electron source is formed and the face plate on which the fluorescent substance is coated are kept at a distance ordinarily of a submillimeter to several millimeters and an interior of the display is kept at a high vacuum as described above.

To accelerate electrons emitted from the electron source, a high voltage not lower than several hundred volts is applied to an anode electrode (metal back) (not shown) between the electron source and the fluorescent substance. Since a magnetic field which exceeds 1 kV/mm in electric field intensity is applied across the fluorescent substance and the electron source, it is feared that electricity may be discharged from the spacer. Furthermore, the spacer is electrified by some of electrons which are emitted from the electron source disposed nearby and bombard the spacer or positive ions which are produced by the emitted electrons and adhere to the spacer. The electrification of the spacer deflects the electrons emitted from the electron source from their due loci and makes the electrons reach positions different from regular positions on the fluorescent substance, whereby an image in the vicinity of the spacer is distorted when it is seen through a front glass plate.

In order to solve this problem, there has been proposed to cancel the electrification by flowing a weak current to the spacer (Japanese Patent Application Laid-Open Nos. 57-118355 and 61-124031). According to this proposal, a thin high resistance film is formed on a surface of an insulating spacer so that a low current runs through a surface of the spacer. An electrification moderating film used for this purpose is a thin mixed crystal film or a metal film which is made of tin oxide or tin oxide and indium oxide.

Since the conventionally used thin film which is made of tin oxide or the like mentioned above is so sensible of gases such as oxygen as it is applied to gas sensors, its resistance is liable to be varied by atmosphere. Furthermore, since these materials and metal films have low specific resistance, it is necessary for obtaining high resistance to form the films in an island-like pattern or extremely thin.

SUMMARY OF THE INVENTION

A primary object of an invention set forth in this application is to provide an electrification moderating film which realizes at least either of preferable suppression of electrification and preferable reduction of electrification, thereby moderating influences due to electrification. The present application includes also an invention which has an object to provide at least any of a highly reproducible film, a stable film and a film having a resistance value hardly varying at a heating step. The present application further includes an invention which has an object to provide a member of an electron beam system, a spacer in particular, which is capable of moderating influences due to electrification. Furthermore, the present application also includes an invention which has an object to provide an electron beam system, an image forming system in particular, which uses such a member.

An electrification moderating film according to one of the inventions set forth in the present application is configured as:

an electrification moderating film characterized by containing at least a germanium compound.

This film is capable of suppressing influences which are produced by electrification.

The germanium compound may be a nitride of germanium or an oxide of germanium.

Furthermore, it is preferable that the germanium compound is a nitride which contains a transition metal and germanium. It is preferable in particular that the transition metal is at least one of chromium, titanium, molybdenum, tantalum and tungsten.

Furthermore, it is preferable that the germanium compound is a nitride which contains a transition metal, aluminium and germanium, and that the transition metal is at least one of chromium, titanium, tantalum, molybdenum and tungsten.

Furthermore, it is preferable that the germanium compound is a nitride of germanium and that germanium of the electrification moderating film is nitrided at a ratio not lower than 50%.

Furthermore, it is preferable that the germanium compound is a nitride which contains a transition metal and germanium and, that germanium of the electrification moderating film is nitrided at a ratio not lower than 50%.

Furthermore, it is preferable that the germanium compound is a nitride which contains a transition metal, aluminium and germanium, and that aluminium of the electrification moderating film has a surface nitrization ratio not lower than 35%. The surface nitrization ratio of aluminium is a quotient of an atomic concentration of nitrogen composing aluminium nitride by an atomic concentration of aluminium.

Furthermore, the electrification moderating film may be formed so as to contain a second layer which contains at least the germanium compound and a first layer which contains at least a metal. The second layer may be insulated.

In this case, the metal is preferably a transition metal. It is preferable that the metal is at least one of iron, cobalt, copper and ruthenium.

Furthermore, it is preferable that the first layer contains at least an oxide of the metal. It is preferable in particular that the first layer contains at least one of iron oxide, cobalt oxide, copper oxide and ruthenium oxide. The first layer may contain a mixture of these metals.

Furthermore, it is preferable that the layer which contains the germanium compound has a thickness not smaller than 10 nm and not larger than 1 $\mu$m.

Furthermore, it is preferable that the germanium compound is a nitride of germanium and that a layer which contains at least the nitride of germanium has a thickness not smaller than 10 nm and not larger than 1 $\mu$m.

Furthermore, it is preferable that the germanium compound is a nitride which contains a transition metal and germanium, and that a layer which contains nitride containing the transition metal and germanium has a thickness not smaller than 10 nm and not larger than 1 $\mu$m.

Furthermore, it is preferable that the germanium compound is a nitride which contains aluminium and germanium, and that a layer which contains the nitride containing aluminium and germanium has a thickness not smaller than 10 nm and not larger than 1 $\mu$m.

Furthermore, it is preferable that the germanium compound is a nitride which contains a transition metal, aluminium and germanium, and that a layer which contains the nitride containing the transition metal, aluminium and germanium has a thickness not smaller than 10 nm and not larger than 1 $\mu$m.

Furthermore, it is preferable in the configuration which uses the first layer and the second layer described above that the first layer has a thickness not smaller than 10 nm and not larger than 1 $\mu$m, and that the second layer has a thickness not smaller than 5 nm and not larger than 30 nm.

Furthermore, it is preferable that the layer which contains at least the germanium compound has a thermal coefficient of resistance which is not larger than 1% in absolute. It is preferable in particular that the thermal coefficient of resistance is negative.

Furthermore, it is preferable that the germanium compound is a nitride of germanium and that a layer which contains at least the nitride of germanium has a thermal coefficient of resistance not larger than 1% in absolute. It is preferable in particular that the thermal coefficient of resistance is negative.

Furthermore, it is preferable that the germanium compound is a nitride which contains a transition metal and germanium, and that a layer which contains at least the nitride containing the transition metal and germanium has a thermal coefficient of resistance not larger than 1% in absolute. It is preferable in particular that the thermal coefficient of resistance is negative.

Furthermore, it is preferable that the germanium compound is a nitride which contains aluminium and germanium, and that a layer which contains at least the nitride containing aluminium and germanium has a thermal coefficient of resistance not larger than 1% in absolute. It is preferable in particular that the thermal coefficient of resistance is negative.

Furthermore, it is preferable that the germanium compound is a nitride which contains a transition metal, aluminium and germanium, and that a layer which contains at least the nitride containing the transition metal, aluminium and germanium has a thermal coefficient of resistance not larger than 1% in absolute. It is preferable in particular that the thermal coefficient of resistance is negative.

Furthermore, it is preferable in the configuration which uses the first layer and the second layer that the first layer has a thermal coefficient of resistance not larger than 1% in absolute. It is preferable in particular that the thermal coefficient of resistance is negative.

An invention set forth in the present application provides an electron beam system which is configured as:

an electron beam system comprising an electron source, an opposed member opposed to the electron source and a first member disposed between the electron source and the opposed member, characterized in that the first member has a substrate and the electrification moderating film described above which is disposed on the substrate.

This configuration is preferable since it is capable of suppressing influences due to electrification of the first member.

For this configuration, it is preferable that the substrate has an insulating property.

Furthermore, the first member is preferably usable as a spacer which maintains a gap between the electron source and the opposed member.

Furthermore, it is preferable that the electrification moderating film exhibits specific resistance not lower than $10^{-7}\times Va$ Ωm and not higher than $10^{5}$ Ωm when a voltage applied across an end of the first member located on a side of the electron source and an end of thereof located on a side of the opposed member is represented by Va.

Furthermore, it is preferable that the substrate contains Na and an Na blocking layer is disposed between the substrate and the electrification moderating film. It is also preferable that at least one of a silicon oxide layer, a zirconium oxide layer or an aluminium oxide layer is disposed between the substrate and the electrification moderating film.

An invention set forth in the present application provides an image forming system which is configured as:

an image forming system comprising an electron source an image forming member which is disposed in opposition to the electron source to form an image when irradiated with electrons, and a fist member which is disposed between the electron source and the image forming member, and characterized in that the first member has the electrification moderating film which is described above and disposed on the substrate.

This configuration is capable of suppressing influences due to electrification of the first member, thereby preferably forming an image.

It is preferable that the first member is connected to an electrode which is disposed in the enclosure, in particular that the first member is preferably connected to a plurality of electrodes disposed in the enclosure which are kept at different potentials. It is preferable that the first member has electrodes which are disposed at and along an end thereof which is connected to the electrode disposed in the enclosure.

Furthermore, it is preferable that the first member is connected to an electrode disposed on the electron source and an electrode disposed on the image forming member. As the electrode disposed on the image forming member, it is preferable to use, for example, an accelerating electrode which is kept at a potential to accelerate electrons emitted from the electron source.

For the configuration in which the first member is connected to the electrode disposed on the electron source, it is preferable to use as the electrode disposed on the electron source an electrode which gives a potential to drive an electron emitting element of the electron source. The electrode which gives the potential to drive the electron emitting element may be, for example, a wiring.

The electron source is preferably one which has a cold-cathode ray tube type electron emitting element. In particular, an electron source with an electron emitting element of the surface conductive type can be used preferably.

Furthermore, the present application includes an invention which provides the electrification moderating film described above.

In addition, an invention set forth in the present application provides a manufacturing method of an image forming system which is configured as:

a manufacturing method of an image forming system which comprises an electron source, an image forming member which is disposed in opposition to the electron source to form an image when irradiated with electrons and a first member which is disposed between the electron source and the image forming member, characterized by comprising a step to form the electrification moderating film described above on a substrate and a step to seal an enclosure after disposing the first member in the enclosure.

It is possible to prevent oxidation of the first member by sealing the enclosure in an atmosphere which suppresses oxidation of the first member. The atmosphere which suppresses oxidation of the first member may be nitrogen atmosphere.

DETAILED DESCRIPTION OF THE PREFERRED EMBODIMENTS

First Embodiment

Figure 1:
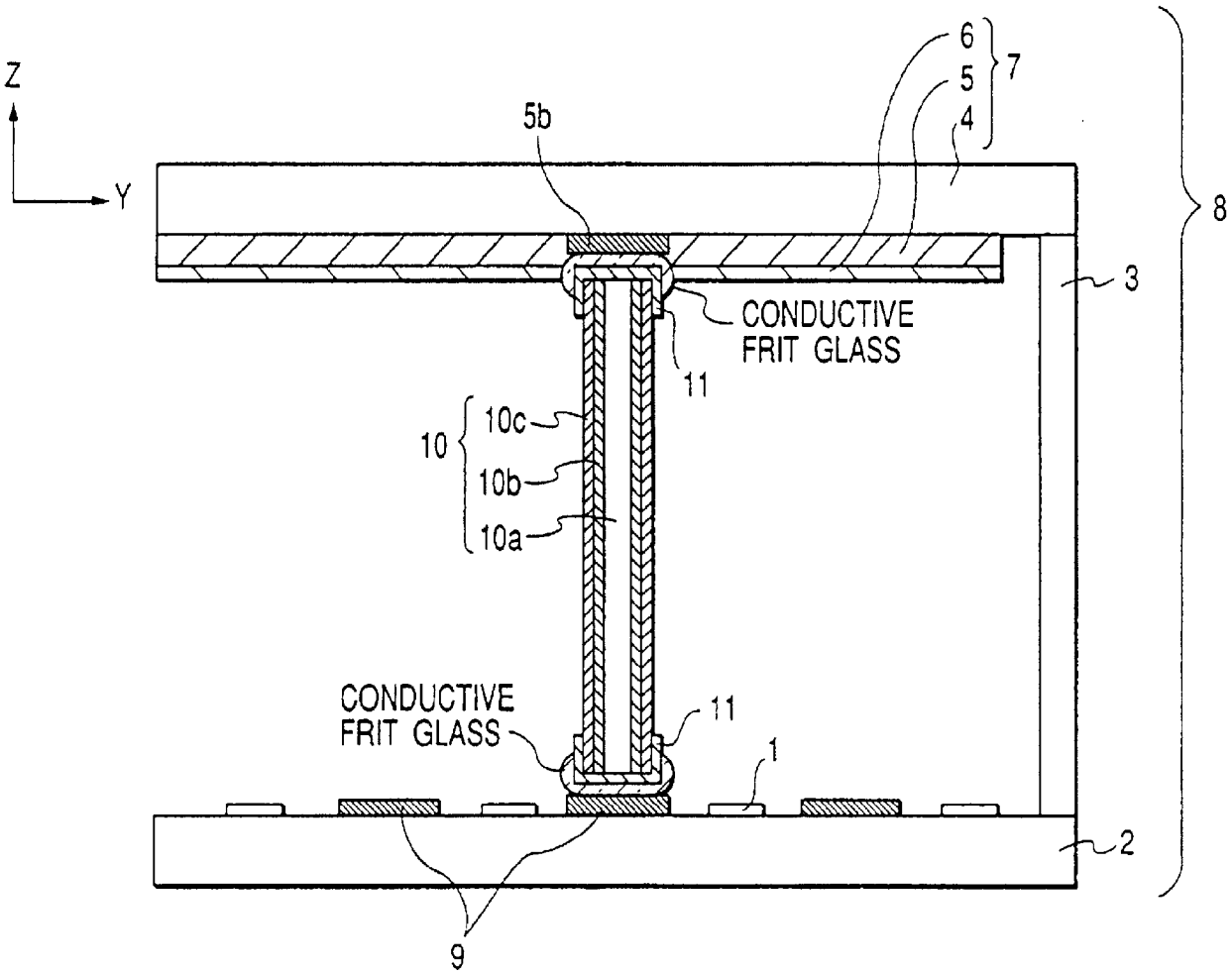
FIG. 1 is a schematic sectional view of a portion of the image forming system according to the present invention which is in the vicinity of spacer.

Though an electrification moderating film which is described in detail below is used on a surface of a spacer of an image forming system using an electron emitting element in a preferable aspect of the present invention, the electrification moderating film is capable of exhibiting a similar effect to lower influences on emitted electrons due to the electrification described above or reduce characteristic variations of the electrification moderating film at a heating step during manufacturing a system which uses an electron emitting element and is suffers from a problem similar to that described above in a case where the electrification moderating film is used on an inside surface of the vessel or on a surface of a member disposed in the vessel.

The electrification moderating film comprises an insulating substrate coated with a conductive film to remove electric charges accumulated on a surface of the insulating substrate. Normally, even though the electrification moderating film has the surface resistance (sheet resistance Rs) of $10^{14}$ Ω/□, the electrification can be moderated at some extent. While, the surface resistance is desirably $10^{12}$ Ω/□. A lower resistance value, or resistance not higher than $10^{11}$ Ω/□, is preferable to obtain a sufficient electrification preventive effect or enhance the effect to remove the electric charges.

When the electrification moderating film is used on a spacer of the display described above, a surface resistance value (Rs) of the spacer is set within a desirable range from viewpoints of the prevention of electrification and power consumption. A lower limit of the sheet resistance is restricted by power consumption. A lower resistance value makes it is possible to remove electric charges accumulated on the spacer more speedily but allows a larger amount of electric power to be consumed by the spacer. A semiconductor material is more preferable than a metallic material having low specific resistance for a spacer to be used on the spacer. It is because an electrification moderating film which is made of a material having low specific resistance must have an extremely small thickness to set the surface resistance Rs at a desired value. A thin film which is thinner than 10 nm is generally formed in an island-like pattern, unstable in resistance and low in reproducibility though these factors are variable dependently on surface energy of a material of the thin film and adhesion to a substrate as well as temperature of the substrate.

Accordingly, semiconductor materials which have specific resistance higher that of metallic conductors and lower than that of insulating materials are preferable, but most of the semiconductor materials have negative thermal coefficients of resistance. A material which has a negative thermal coefficient of resistance allows a resistance value to be lowered by a temperature rise due to power consumed on the surface of the spacer, thereby causing the so-called thermal runaway where temperature further heat generation continuously raises temperature and produced an overcurrent. However, the thermal runaway does not take place in a condition where a calorific value, or power consumption, is balanced with heat dissipation. Moreover, the thermal runaways hardly take place when the electrification moderating film has a thermal coefficient of resistance (TCR) which is small in absolute.

In a condition where the spacer used an electrification moderating film which had TCR of −1%, it has been experimentally confirmed that power consumption exceeding a level of approximately 0.1 W per square centimeter continuously increased a current supplied to the spacer, thereby causing the thermal runaway condition. Though if depends on a shape of spacer, the voltage Va applied across the spacer and a thermal coefficient of resistance of an electrification moderating film, a value of Rs which does not allow power consumption to exceed 0.1 W per square centimeter is not smaller than $10\times Va^2/h^2$ Ω/□. The reference symbol h represents a distance between members between which the spacer is disposed, or a distance between the face plate and the rear plate in the display described above. Since h is set at a distance not longer than 1 cm in an image forming system typically represented by the planar surface type display, it is desirable that the sheet resistance Rs of an electrification moderating film to be formed on the spacer is set within a range from $10\times Va^2$ Ω/□ to $10^{11}$ Ω/□.

It is desirable that thickness t of the electrification moderating film formed on the insulating substrate is not smaller than 10 nm as described above. When the thickness exceeds 1 μm, on the other hand, the film may peel off at a higher possibility due to a strong stress applied to it and productivity of the film is lowered since a longer time is required to form the film. It is therefore desirable that the film thickness is 10 nm to 1 μm, preferably 20 to 500 nm.

From the preferable ranges of Rs and t described above, it is desirable that specific resistance ρ of the electrification moderating film which is a product of the sheet resistance Rs multiplied by the film thickness t is $10^{-7}\times Va^2$ Ωm to $10^5$ Ωm. Furthermore, it is desirable that ρ is $(2\times10^{-7})$ $Va^2$ Ωm to $5\times10^4$ Ωm to obtain sheet resistance and thickness which are within more preferable ranges.

The electron accelerating voltage Va which is not lower than 100 V is used in a display and a voltage which is not lower than 1 kV is required to obtain sufficiently brightness when the planar surface type display uses a fluorescent substance for high-speed electrons which is ordinarily used for CRTs. In a condition of Va=1 kV, it is preferable that the electrification moderating film has specific resistance within a range of 0.1 Ωm to $10^5$ Ωm.

Earnest examinations of materials which have the characteristics of the electrification moderating film described above provided a result that nitrides of germanium and a transition metal in particular are extremely excellent materials for the electrification moderating film. The transition metal is selected from among Ti, V, Cr, Mn, Fe, Co, Ni, Cu, Zr, Nb, Mo, Hf, Ta, W and so on and may be used independently or in a combination of two or more kinds. The transition metals and nitrides thereof are good conductors, whereas germanium nitride is an insulating material. Accordingly, it is possible by adjusting compositions of the transition metal and germanium to control a value of specific resistance within a broad range so that the electrification moderating film is a good conductor or an insulating material. That is, it is possible by varying a composition of the transition metal mentioned above to obtain the value of specific resistance described above which is desirable for the electrification moderating film of the spacer.

Specific resistance of a material composed of germanium and nitride of Cr, Ti or Ta varies depending on metal compositions (transition metal/germanium). The preferable specific resistance described above is obtained at approximately 3 at. % to 50 at. % of Cr, 30 at. % to 68 at. % of Ti or 35 at. % to 80 at. % of Ta. When Mo is selected as a transition metal, atomic ratios (Mo/Ge) of approximately 3 at. % to 50 at. % give the preferable specific resistance, whereas atomic ratios of approximately 3 at. % to 60 at. % allow to obtain the preferable specific resistance in case of W.

At a manufacturing stage of an image forming system described later in particular, it has been found that an electrification moderating film made of the transition metal mentioned above and germanium was a stable material which allowed little variation of its resistance value. The electrification moderating film is a material having a thermal coefficient of resistance which is negative but smaller than 1% in absolute, thereby hardly allowing the thermal runaway. Since the nitrogen compound emits secondary electrons at a low rate, the electrification moderating film is a material which can hardly be electrified when irradiated with electrons and is suited for use in displays utilizing electron beams.

As the electrification moderating film according to the present invention, a thin film which is composed of the nitrides of the transition metal mentioned above and germanium can be formed on an insulating substrate by a sputtering method, a reactive sputtering method, an electron beam vaporization method, an ion plating method, an ion-assisted vaporization method or CVD method. In case of the sputtering method, for example, a film which is composed of the nitrides of germanium and the transition metal mentioned above can be obtained by sputtering targets of germanium and the transition metal in a gas containing at least either of nitrogen and ammonium, thereby nitriding atoms of the sputtering metals. It is possible to use a target of an alloy of germanium and the transient metal having a composition which is preliminarily adjusted. Though a nitrogen content of a nitride film is varied by adjusting sputtering conditions such as a gas pressure, a partial nitrogen pressure and film forming speed, the film has a higher stability when it is nitrided sufficiently.

Though resistance values of the nitrides vary depending on a nitrogen concentration and defects in a nitride film, a conductivity due to the defects is varied when the defects are lessened at a heating step. Accordingly, a nitride film which is sufficiently nitrided and has fewer defects is apt to be more excellent in stability. Since germanium is transformed into the nitride and the transition metal element is used to impart a conductivity, the electrification moderating film for the spacer according to the present invention is highly stable. To obtain a nitride film which has a stable resistance value, it is preferable to nitride germanium atoms at 50% or higher and more preferable to nitride at 60% or higher in particular.

When it is desired to suppress oxidation, it is preferable to manufacture the image forming system in an atmosphere which does not oxide the nitride film. A nitride which contains nitrogen at a ratio lower than a stoichiometric ratio is liable to be oxidized and a nitride which has a higher crystalline orientation such as the nitride film used in the present invention which is polycrystalline is liable to be hardly oxidized. A secondary electron emission rate which influences on electrification is governed by a material of a surface which is scores of nanometers thick.

A nitrogen content (nitrization ratio) in a nitride can be enhanced by selecting an adequate manufacturing condition to penetrate high energy nitrogen ions into a deposited surface of a thin film, for example, a condition for deposition by sputtering while applying a negative bias voltage to a substrate. Such a manufacturing condition tends to improve a crystalline orientation and enhancement of a nitrization ratio results in improvement in performance of the electrification moderating film. In the present invention, the nitrization ratio means an atomic concentration ratio of germanium nitride relative to germanium which is measured by an XPS (X-ray spectroscopy).

Even when a surface of the nitride film is oxided or an oxide layer is formed on the nitride film, the electrification moderating film exhibits an electrification preventive effect so far as the surface oxide layer has a low secondary electron emission rate.

Though description has been made above of a case wherein the electrification moderating film is used on the spacer for display, the nitride described above which has a high melting point and high hardness is a highly useful material which is usable, as described above, not only on the spacer for display but also as a cover on an inside surface of an enclosure of a system which comprises an electron emitting element disposed in the enclosure or on a surface of a member disposed in the enclosure which has specifications similar to those of the spacer.

As electron emitting elements which are usable in the image forming system according to the present invention, there are known two kinds of electron emitting elements: thermo electron type and cold-cathode type. The cold-cathode ray type electron emitting elements are classified into a field-emission type (hereinafter abbreviated as FE type) electron emitting element, a surface conduction type electron emitting element, a metal/insulating layer/metal type (herein after abbreviated as MIM type) electron emitting element and so on. The cold-cathode type electron emitting element is preferably used for the present invention though this type electron emitting element is not limitative.

The surface conduction type electron emitting element is exemplified by M. I. Elinson, Radio Eng. Electron Pys. 10, (1965). The surface conduction type electron emitting element utilizes a phenomenon wherein electrons are emitted by supplying a current to a thin film having a small area formed on a substrate in a direction in parallel with a surface of the film. Reported as the surface conduction type electron emitting elements are elements using thin $SnO_2$ films proposed by Elinson et al. mentioned above, elements using thin Au films [G. Dittmer: "Thin Solid Films," 9317 (1972)], elements using thin $In_2O_3/SnO_2$ films [M. Hartwell and C. G. Fonstad: "IEEE Trans. ED Conf.," 519 (1975)], elements using thin carbon films [Hisashi Araki et al.: "Vacuum," Vol. 26, No. 1, p. 22 (1983)] and so on. Further, there are known electron emitting elements which use films of fine particles in electron emitting sections or the like as described later in embodiments of the present invention. Known as examples of the FE type electron emitting elements are W. P. Dyke & W. W. Dolan: "Field emission," Advance in Electron Physics, 8, 89 (1956) and C. A. Spindt: "PHYSICAL Properties of thin-film field emission cathodes with molybdenum cones," J, Appl. Phys., 47, 5248 (1976) and so on. Known as examples of MIM type electron emitting elements are C.A. Mead: "The tunnel-emission amplifier," J. Appl. Phys., 32,646 (1961) and so on.

The image forming system according to the present invention may be configured as described below:

(1) The image forming system forms an image by irradiating an image forming member with electrons which are emitted from electron emitting elements in correspondence to input signals. An image display unit in particular can be configured so as to have an image forming member which is made of a fluorescent substance.

(2) The electron emitting elements can be arranged in a simple matrix which has a plurality of cold-cathode elements which are wired in a matrix pattern through a plurality of wires in a direction of line and a plurality of wires in a direction of row.

(3) The electron emitting elements can be arranged in a ladder pattern wherein a plurality of cold-cathode elements are arranged in parallel (referred to as a line direction) to form a plurality of lines, the cold-cathode elements being connected to one another at ends thereof and control electrodes (referred to as grids) are arranged over the cold-cathode elements along a direction orthogonal to the wires in a line direction (referred to as a row direction) to control electrons from the cold-cathode elements.

(4) According to a concept of the present invention, the image display unit is not limitative and may be substituted for a light emitting source such as a light emitting source for an optical printer which is composed of a photosensitive drum and light emitting diodes. In such a case, not only a linear light emitting source but also a two-dimensional light emitting source can be composed by adequately selecting the m wires in the line direction and n wires in the row direction described above. The image forming member is not limited to a substance such as a fluorescent substance used in embodiments described later but may be a member which forms a latent image by electrification of electrons.

According to the concept of the present invention, the present invention is applicable to an instrument, for example, an electron microscope in which a member to be irradiated with electrons emitted from an electron source is other than an image forming member made of a fluorescent substance or the like Accordingly, the image forming apparatus according to the present invention may be a general electron beam instrument for which a member to be irradiated with electrons is not limited.

Now, description will be made concretely of the electrification moderating film according to the present invention and an image forming system which is equipped with a spacer using the electrification moderating film.

FIG. 1 is a schematic sectional view mainly showing a spacer 10. In FIG. 1, a reference numeral 1 represents an electron source, a reference numeral 2 designates a rear plate, a reference numeral 3 denotes a side wall, and a reference numeral 7 represents a face plate: the rear plate 2, the side wall 3 and the face plate 7 composing an airtight vessel (an enclosure 8) which maintains an interior of a display panel under vacuum.

Figure 15A:
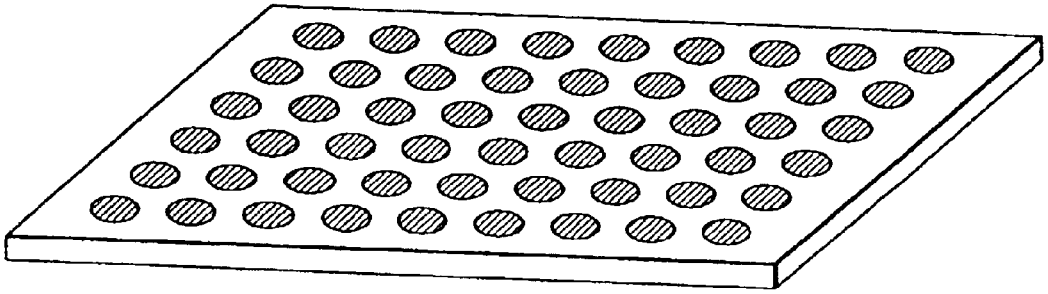
FIGS. 15A and 15B are perspective views illustrating other spacers to be used in the image forming system according to the present invention.
Figure 15B:
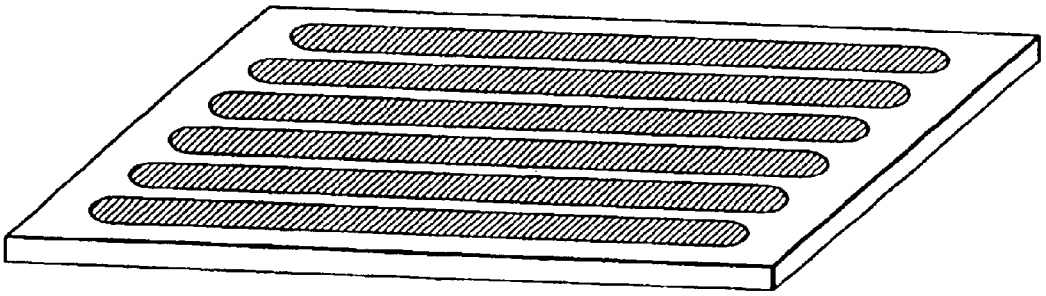

The spacer 10 consists of an insulating substrate 10*a* formed on a surface which is an electrification moderating film 10*c* according to the present invention. The spacer 10 is disposed to prevent the vacuum enclosure 8 from being broken or deformed by an atmospheric pressure when the enclosure 8 is evacuated to a vacuum degree. A material, a shape, a location and a number of the spacer 10 are determined considering a form and a thermal expansion coefficient of the enclosure 8 as well as an atmospheric pressure, heat and the like which are to be applied to it. A shape of the spacer may be that of a planar plate, a cross type or an L type and the spacer may be a hole bored at a location corresponding to each electron source or one of a plurality of electron sources as shown in FIGS. 15A and 15B. The spacer 10 exhibits an effect which is more remarkable as the image forming system is larger.

A material such as glass or a ceramic which has high mechanical strength and high heat resistance is suited for the insulating substrate 10*a* which must be bearable of an atmospheric pressure applied to the face plate 7 and the rear plate 2. When glass is used as a material for the face plate and the rear plate, it is desirable to select for the insulating substance 10*a* of the spacer the same material or a material which has a thermal expansion coefficient similar to that of glass to suppress thermal stresses during manufacturing the image forming system.

When a glass material which contains alkali ions such as soda glass as a material for the insulating substrate 10*a*, an electrical conductivity, etc. of the electrification moderating film may be varied, for example, by Na ions, but it is possible to prevent the alkali ions such as Na ions from penetrating into an electrification moderating film 10*c* by forming an Na block layer 10*b*, which is Si nitride, Al oxide, etc., between the insulating substrate 10*a* and the electrification moderating film 10*c*.

The electrification moderating film 10*c* is made of nitrides of germanium and a transition metal which is, for example, Ti, Cr or Ta.

The spacer 10 is electrically connected to a metal back 6 and an X direction wire 9 (described later in detail) to apply a voltage which is nearly equal to an accelerating voltage Va across both ends of the spacer 10. Though the spacer 10 is connected to the wire in the first embodiment, it may be connected to an electrode which is formed separately. In a configuration wherein an intermediate electrode plate (grid electrode or the like) is disposed between the face plate 7 and the rear plate 2 to shape an electron beam or prevent an insulating portion of the substrate from being electrified, the spacer may run through the intermediate electrode plate or may be connected separately by way of the intermediate electrode plate.

Electrodes 11 which are made of a good conductive material such as Al or Au and formed at both ends of the spacer are effective to enhance electrical conductivity between the electrification moderating film and the electrodes on the face plate and the rear plate.

Then, description will be made of a fundamental configuration of an image forming system which uses the spacer 10 described above. A perspective view of a display panel using the spacer described above is shown in FIG. 2, wherein the display panel is partially cut off to show an internal structure.

Figure 2:
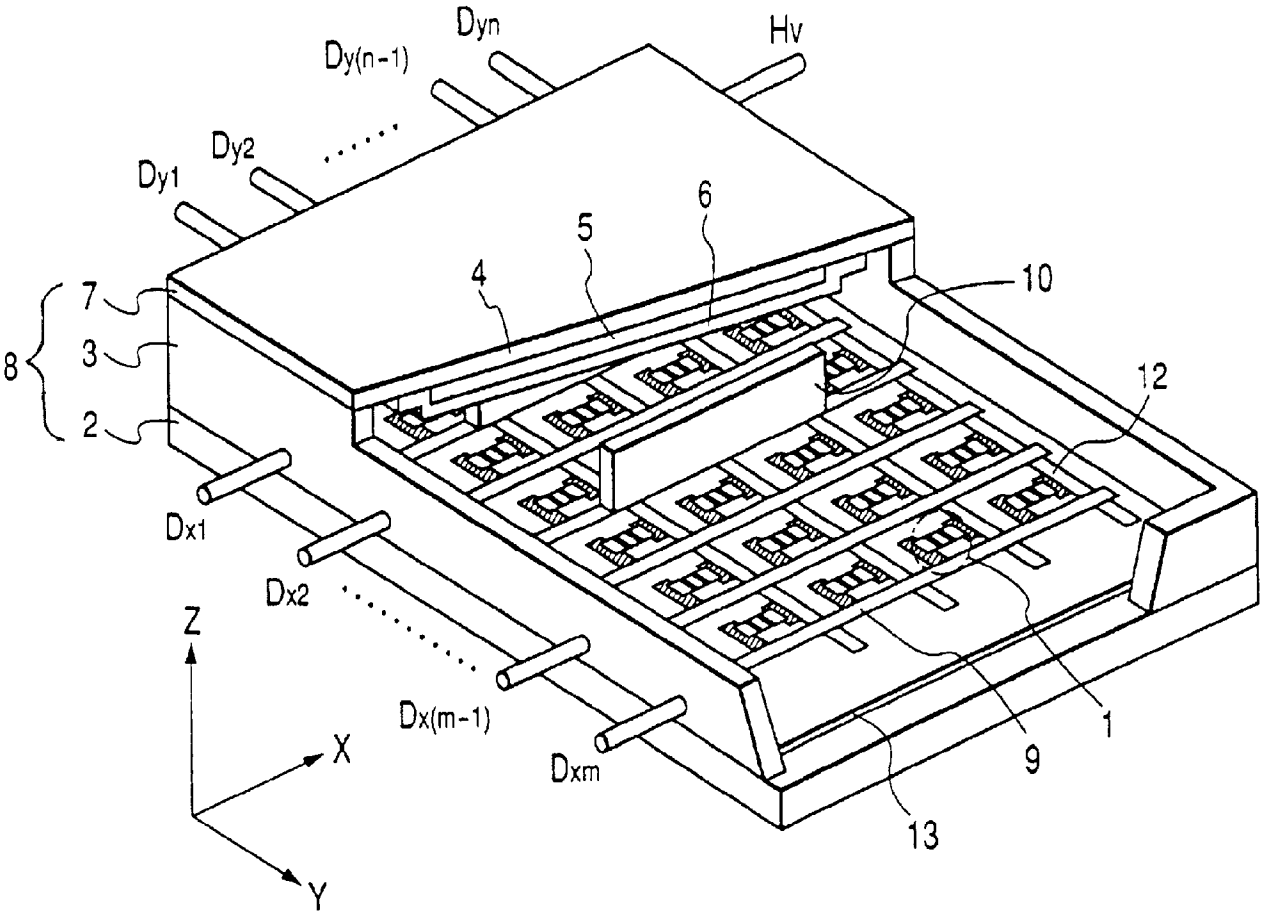
FIG. 2 is a perspective view of an image forming system preferred as an embodiment of the present invention from which a portion of a display panel is cut off.
Figure 3:
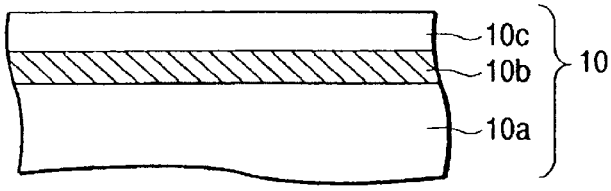
FIG. 3 is a schematic sectional view used in a spacer according to the present invention.

In FIG. 2 which uses reference numerals similar to those in FIG. 1, a reference numeral 2 represents a rear plate, a reference numeral 3 designates a side wall and a reference numeral 7 denotes a face plate: the rear plate 2, the side wall 3 and the face plate 7 composing an airtight vessel (enclosure 8) which maintains an interior of a display panel under vacuum. In assembling the airtight vessel, it is necessary to seal parts, for example, by applying frit glass to joints of parts and calcining them in atmosphere or a nitrogen atmosphere at 400 to 500° C. for 10 minutes or longer so that the joints have sufficient strength and airtightness. The nitrogen atmosphere is more preferable since it does not oxidize a nitride film formed on a spacer. The method for evaluating air to make an interior of the airtight vessel vacuum will be described later.

Fixed to the rear plate 2 is a substrate 13 on which cold-cathode type electron emitting elements 1 are formed in a number of N×M (N and M are positive integers of 2 or larger which are selected adequately depending on a desired number of display pixels. For an image forming system which is to display a high definition TV image, for example, it is desirable that N is not smaller than 3000 and M is not smaller than 1000). The cold-cathode type electron emitting elements in the number of N×M are arranged in a simple matrix with M wires 9 in an X direction and N wires 12 in a Y direction. A section which is composed of the cold-cathode type electron emitting elements 1, the wires 9 in the X direction, the wires 12 in the Y direction and the substrate 13 is referred to as a multi-electron beam source. A manufacturing method and a structure of the multi-electron beam source are described later in detail.

Though the substrate 13 of the multi-electron beam source is fixed to the rear plate 2 of the airtight vessel in the first embodiment, the substrate 13 may be used as the rear plate of the airtight vessel when the substrate 13 of the multi-electron beam source has sufficient strength.

Figure 4A:
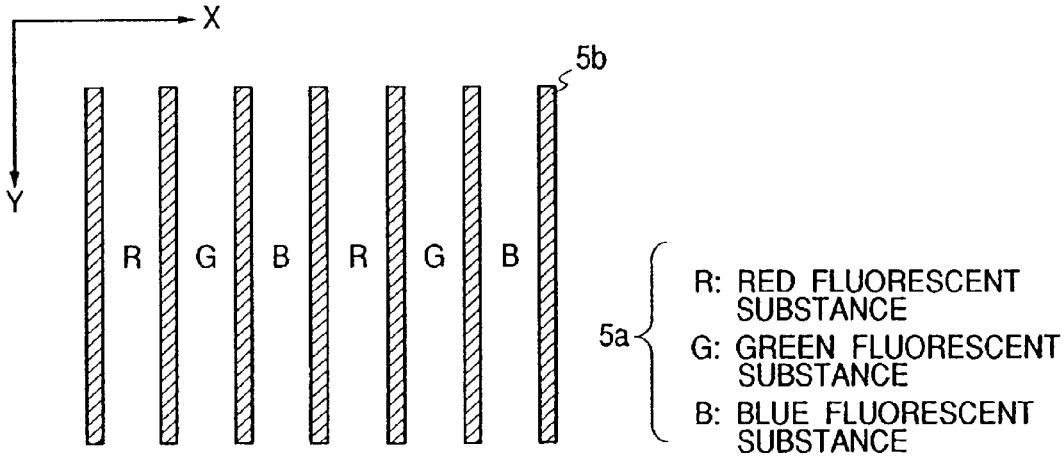
FIGS. 4A and 4B are plan views exemplifying arrangements of fluorescent substances on a face plate of a display panel.

Furthermore, a fluorescent film 5 is formed on a bottom surface of the face plate 7. Since the first embodiment is a color image forming system, red, green and blue fluorescent substances of the three primary colors which are used in a field of CRT are coated separately on the fluorescent film 5. The fluorescent substances are coated in stripes and black belts 5*b* are disposed between the stripes of the fluorescent substances, for example, as shown in FIG. 4A. The black belts 5*b* are disposed to prevent display colors from being deviated even when irradiated locations are slightly deviated and to prevent contrast from being lowered due to reflection of external rays. Though graphite is used as a main component of the black belts 5*b*, another material may be selected so far as it is suited for the purposes described above. The black belts 5*b* may be electrically conductive.

Figure 4B:
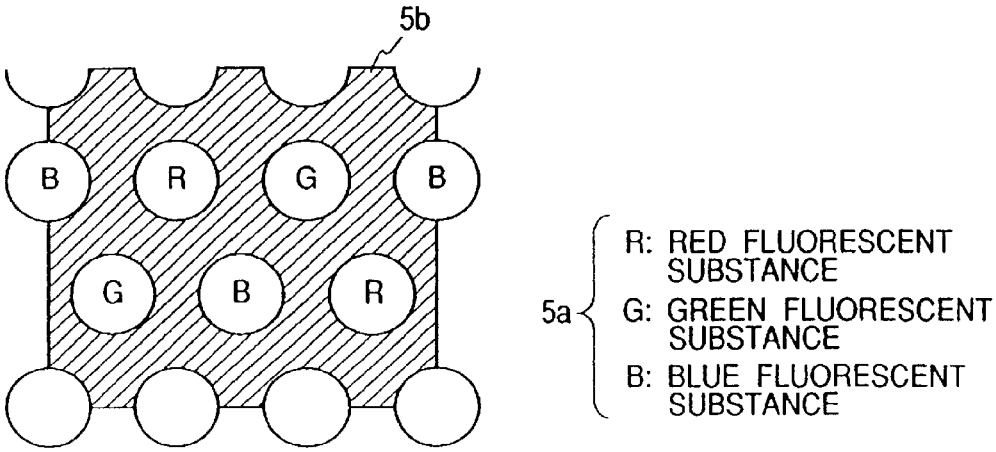

The fluorescent substances of the three primary colors may be coated not in the stripe arrangement shown in FIG. 4A but in a delta arrangement as shown in FIG. 4B or another arrangement.

A monochromatic fluorescent substance is used for the fluorescent film 5 to manufacture a monochromatic display panel and a black conductive material may not always be used.

Furthermore, a metal back 6 known in the field of CRT is disposed on a surface of the fluorescent film 5 which is located on a side of the rear plate. The metal back 6 is disposed so that it reflects a portion of rays emitted from the fluorescent film 5 on a mirror surface to enhance a utilization ratio of rays, protects the fluorescent film 5 from bombardment of negative ions, serves as an electrode to apply an electron beam accelerating voltage and functions as a conduction path for electrons which have excited the fluorescent film 5. The metal back 6 is formed by smoothing a surface of the fluorescent film and vacuum deposition of Al on the surface after the fluorescent film 5 is formed on a face plate substrate 4. The metal back 6 may not be used when a fluorescent material for a low accelerating voltage is used on the fluorescent film 5.

Furthermore, a transparent electrode which is made of ITO, for example, may be disposed between the face plate substrate 4 and the fluorescent film 5 to apply an accelerating voltage and enhance conductivity of the fluorescent film though such a transparent electrode is not used in the first embodiment.

Reference symbols $D_{xl}$ through $D_{xm}$, $D_{yl}$ through $D_{yn}$ and Hv represent airtight terminals which are disposed for electrical connection between the display panel and an electric circuit (not shown). $D_{xl}$ through $D_{xm}$, $D_{yl}$ through $D_{yn}$ and Hv are electrically connected to the wires in the X direction of the multi-electron beam source, the wires in the Y direction of the multi-electron beam source and the metal back 6 of the face plate respectively.

After the airtight vessel has been assembled, it is evacuated to a pressure on the order of $1^{-5}$ [Pa] with an evacuating pipe (not shown) and a vacuum pump connected to the airtight vessel, in order to evacuate air to make an interior of the airtight vessel vacuum. A getter film (not shown) is formed at a predetermined location in the airtight vessel to maintain the pressure in the airtight vessel immediately before or after a subsequent step to seal the evacuating pipe. The getter film is formed by heating and depositing a getter material having a principal component, for example, of Ba by a heater or electronic heating and has an adsorbing function which maintains an internal pressure of the airtight vessel at a level of $10^{-3}$ to $10^{-5}$ [Pa].

Then, description will be made of a method to manufacture the multi-electron beam source used in the display panel of the first embodiment. So far as cold-cathode type electron emitting elements are arranged in a simple matrix in a multi-electron beam source, it is usable in the image forming system according to the present invention regardless of a material and manufacturing method of the cold-cathode type electron emitting elements. Accordingly, cold-cathode type electron emitting elements, for example, surface conduction type, FE type and MIM type electron emitting elements are usable.

Under circumstances to demand an image forming system which has a large display screen and can be manufactured at a low cost, however, the surface conduction type electron emitting elements are preferable in particular out of the cold-cathode type electron emitting elements. Speaking concretely, the FE type electron emitting element has a characteristic which is largely dependent on relative positions and shapes of an emitter cone and a gate electrode, thereby requiring an extremely high manufacturing techniques which are disadvantageous to prepare a display screen having a large area and manufacture an image forming system at a low cost. Furthermore, the MIM type electron emitting element requires thinning and uniformalizing an insulating layer and an upper electrode film, thereby also being disadvantageous to prepare a display screen having a large area and manufacture an image forming system at a low cost. In contrast, the surface conduction type electron emitting element which can be manufactured by a relatively simple method facilitates to prepare a display screen having a large area and manufacture an image forming system at a low cost. The inventor et al. have found that a surface conduction type electron emitting element which has an electron emitting portion and surroundings thereof formed from a fine particle film in particular is excellent in its electron emitting characteristic in particular and can easily be manufactured. It can therefore be said that this electron emitting element is most suited for use in a multi-electron beam source of an image forming system equipped with a display screen which has high brightness and a large area. Accordingly, surface conduction type electron emitting elements which are formed from a fine particle film are used in the display panel of the first embodiment described above. Description will be made first of a fundamental configuration and manufacturing method of a preferable surface conduction type electron emitting element and then a configuration of a multi-electron beam source in which a large number of elements are arranged in a matrix.

[Preferable configuration of surface conduction type electron emitting element and manufacturing method therefor]

A typical configuration of the surface conduction type electron emitting elements formed having an electron emitting portion and surrounding thereof which are formed from a fine particle film is classified into a planar surface type and a vertical type.

(Planar surface type surface conduction electron emitting element)

First, description will be made of an element configuration and a manufacturing method of the planar surface type surface conduction electron beam emitting element.

Figure 5A:
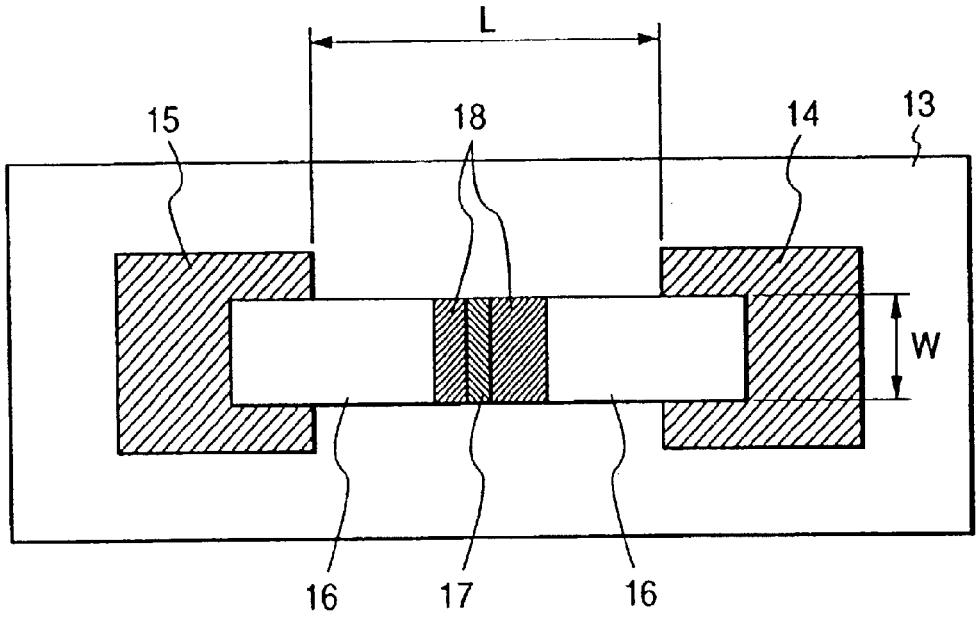
FIGS. 5A and 5B are a plan view and a sectional view of a substrate for a multi-electron beam source.
Figure 5B:
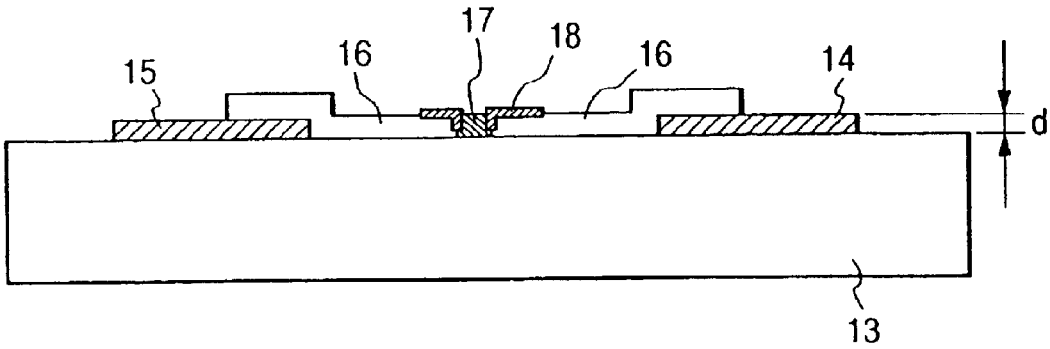

FIG. 5A is a plan view descriptive of a configuration of the planar surface type surface conduction electron emitting element and FIG. 5B is a sectional view of the surface conduction electron emitting element shown in FIG. 5A. In FIGS. 5A and 5B, a reference numeral 13 represents a substrate, a reference numerals 14 and 15 designate element electrodes, a reference numeral 16 denotes a conductive film, a reference numeral 17 represents an electron emitting portion which is formed by an energization forming processing and a reference numeral 18 designates a thin film which is formed by an energization activating processing.

Usable as the substrate 13 is a glass substrate which is made, for example, of a glass material such as silica glass or green glass, a ceramic substrate which is made of a material such as alumina or a substrate on which an insulating layer made, for example, of $SiO_2$.

The element electrodes 14 and 15 which are disposed in parallel with a surface of the substrate 13 are made of a conductive material. A material of these electrodes are adequately selectable, for example, from among metals such as Ni, Cr, Au, Mo, W, Pt, Ti, Cu, Pd and Ag, alloys of these metals, metal oxides such as $In_2O_3$—$SnO_2$ and semiconductors such as polysilicon. These electrodes can easily be formed by combining a film forming technique such as vacuum deposition with a patterning technique such as photolithography or etching and may be formed by another method (for example, a printing technique).

Shapes of the element electrodes 14 and 15 are adequately configured in accordance with a purpose of application of the electron emitting elements. Though the electrodes are generally configured to reserve an adequate gap within a range from scores of nanometers to scores of micrometers, a gap within a range from several micrometers to scores of micrometers is preferable to apply the element electrodes to the image forming system. Furthermore, a thickness d of the element electrodes is generally adequately selected within a range from several tens of nanometers to several micrometers.

A fine particle film is used as the thin conductive film 16. The fine particle film described herein is a film which contains a large number of fine particles (including island-like assemblies) as its components. A microscopic inspection of a fine particle film ordinarily permits observing a structure wherein fine particles are arranged apart from one another, adjacent to one another or overlapped with one another.

Though particle sizes of the fine particles contained in a fine particle film are included within a range from 1/10 of several nanometers to hundreds of nanometers, it is preferable that the fine particle film which is to be used as the thin conductive film 16 has a particle size within a range from 1 nm to 20 nm. Conditions which are taken into consideration to determine a thickness of the fine particle film are: a condition required to make favorable electric connection from the conductive film 16 to the element electrode 14 or 15, a condition required to favorably perform an elecroforming processing described later and a condition required to set electric resistance of the fine particle film itself at an adequate value described later. Speaking concretely, the thickness is set within a range from 1/10 of several nanometers to hundreds of nanometers, preferably within a range from 1 nm to 50 nm.

A material to be used for forming the fine particle film is selected adequately, for example, from among substances mentioned below: metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge, and carbon.

The conductive film 16 which is formed from the fine particle film as described above has sheet resistance within a range from $10^3$ to $10^7$ [ohms/sq].

Since it is desirable to establish favorable electrical connection between the thin conductive film 16 and the element electrodes 14 and 15, these members are configured to be partially overlapped with each other. These members are overlapped in an order from an underside of the substrate, the element electrodes and the thin conductive film in an example shown in FIGS. 5A and 5B, but may be overlapped in the order from the underside of the substrate, the thin conductive film and the element electrodes.

The electron emitting portion 17 is a crack-like portion which is formed in a portion of the thin conductive film 16 and has electrical resistance which is higher than that of the conductive film which surrounds the electron emitting portion. The crack is formed by energization forming processing of the thin conductive film 16 described later. Fine particles which have particle sizes from 1/10 of several nanometers to several tens of nanometers may be disposed in the crack. The electron emitting portion is schematically shown in FIGS. 5A and 5B since an actual location and an actual shape of the electron emitting portion can hardly be traced precisely and accurately.

A thin film 18 which is made of carbon or carbide covers the electron emitting portion 17 and surroundings thereof. The thin film 18 is formed by an energization activating processing described later after the energization forming processing.

The thin film 18 is made of single-crystal graphite, polycrystalline graphite, non-crystalline carbon or a mixture thereof and has a thickness not larger than 50 nm, more preferably not larger than 30 nm.

A location and a shape of the thin film 18 are schematically shown in FIGS. 5A and 5B since its actual location and actual shape can hardly be traced precisely.

While a preferable configuration of the element have been described above, the first embodiment used an element which is described below:

A green glass sheet was used as the substrate 13, whereas thin Ni films were used as the element electrodes 14 and 15. The element electrodes had a thickness d of 100 nm and were arranged so as to reserve a gap L of 2 $\mu$m therebetween.

Using Pd or PdO as a main material for the fine particle film, the film was configured to have a thickness of approximately 10 nm and a width W of 10 nm.

Now, description will be made of a method to manufacture a preferable planar surface type surface conduction electron emitting element. Sectional views descriptive of steps to manufacture the surface conduction electron emitting element are shown in FIGS. 6A to 6E, wherein component members which are the same as those shown in FIGS. 5A and 5B are represented by the same reference numerals.

Figure 6A:
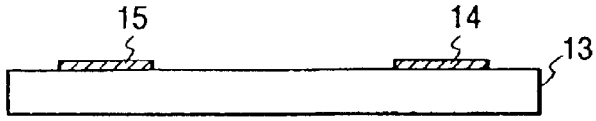
FIGS. 6A, 6B, 6C, 6D and 6E are diagrams illustrating steps to form a planar surface type surface conductive electron emitting element.

1) First, the element electrodes 14 and 15 are formed on the substrate 13 as shown in FIG. 6A. To form these electrodes, a material of the element electrodes is deposited after sufficiently washing the substrate 13 with a detergent, pure water and an organic solvent (the material can be deposited by a vacuum film forming technique, for example, vaporization method or a sputtering method). Then, a pair of electrodes 14 and 15 are formed by patterning the deposited electrode material with a photolithography etching technique.

Figure 6B:
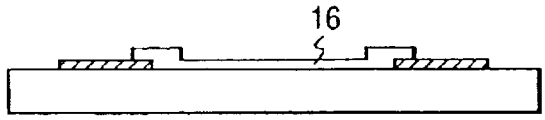

2) Then, a thin conductive film 16 is formed as shown in FIG. 6B. To form the thin conductive film, a solution of an organic metal is applied to the substrate 13 on which the element electrodes 14 and 15 have been formed, dried and heated for calcination, thereby forming a fine particle film and the fine particle film is patterned into a predetermined shape by photolithography etching. The solution of the organic metal herein is a solution of a compound of an organic metal which mainly contain an element selected as a material for fine particles used in the thin conductive film. Speaking concretely, Pd was used as a main element in the first embodiment. A dipping method was used as an applying method in the first embodiment, but another method, for example, a spinner method or a spraying method may be used instead.

A method other than the method to apply the solution of the organic metal used in the embodiment, for example, the vacuum deposition method, the sputtering method or a chemical vapor phase deposition method may be used as a method to form the thin conductive film made of a fine particle film.

Figure 6C:
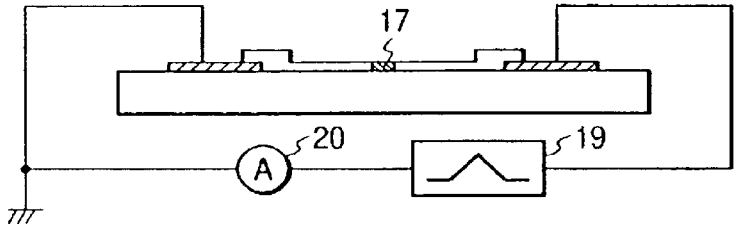

3) Then, an electron emitting portion 17 is formed by the energization forming processing while applying an adequate voltage across the element electrodes 14 and 15 from a forming power source 19 as shown in FIG. 6C.

The energization forming processing is carried out to change a portion of the thin conductive film 16 which is made of the fine particle film into a structure preferable to emit electrons by adequately breaking the portion or changing a shape or a property of the portion while applying a voltage to the thin conductive film 16. A crack is formed adequately in the portion (the electron emitting portion 17) of the thin conductive film made of the fine particle film which is changed into the structure preferable to emit electrons. Electrical resistance as measured between the element electrodes 14 and 15 is remarkably enhanced after the formation of the electron emitting portion 17 as compared with that before the formation of the electron emitting portion 17.

Figure 7:
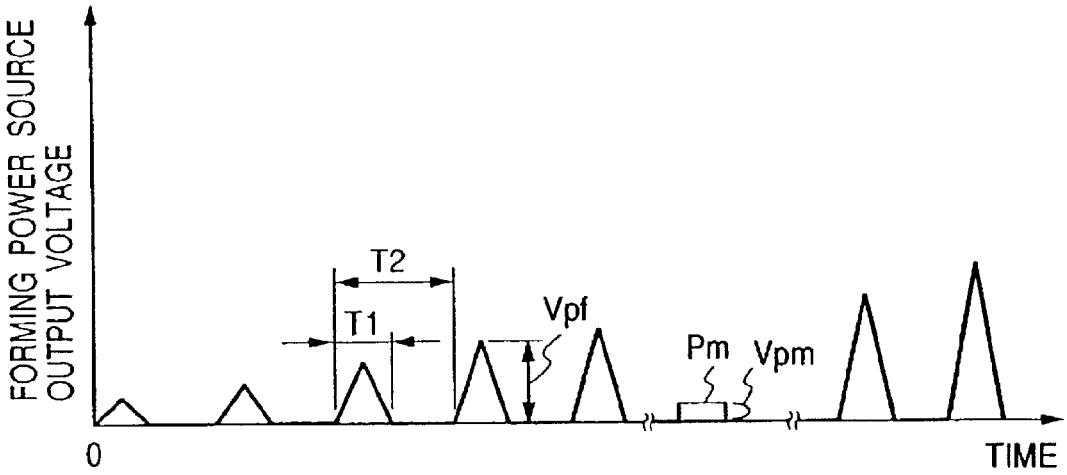
FIG. 7 is a diagram illustrating waveforms of pulses applied to form an electron beam source.

To describe the voltage application method in more detail, FIG. 7 exemplifies waveforms of an adequate voltage supplied from the forming power source 19. Since a voltage which has pulse-like waveforms is preferable to form the thin conductive film made of the fine particle film, triangular pulses each having a pulse width T1 were successively applied at intervals of T2 in the first embodiment as shown in FIG. 7. During application of the voltage, a crest value Vpf of the triangular pulse was enhanced progressively. Furthermore, monitor pulses Pm were interposed between the triangular pulses at adequate intervals to monitor a shape of the electron emitting portion 17 and a current which flowed during application of the monitor pulse was measured with an ammeter 20.

In the first embodiment, the pulse width $T_1$ and the pulse interval $T_2$ were set, for example, at 1 millisecond and 10 milliseconds respectively in a vacuum atmosphere on the order of $10^{-3}$ Pa, and the crest value Vpf was enhanced at a step of 0.1 V for each pulse. The monitor pulse Pm was interposed each time five triangular pulses were applied. A voltage Vpm of the monitor pulse was set at 0.1 V so that it produced no adverse influence on the forming processing. The voltage application for the forming processing was terminated at a stage where electrical resistance between the element electrodes 14 and 15 was $1\times10^6$ ohms, or the ammeter 20 reads $1\times10^{-7}$ A or low while the monitor pulse is applied.

The method described above is preferable for the surface conduction type electron emitting element adopted for the first embodiment, and it is desirable to adequately modify the conditions for the voltage application dependently on modifications of design of the surface conduction type electron emitting element, for example, the material and thickness of the fine particle film or the interval L between the element electrodes.

Figure 6D:
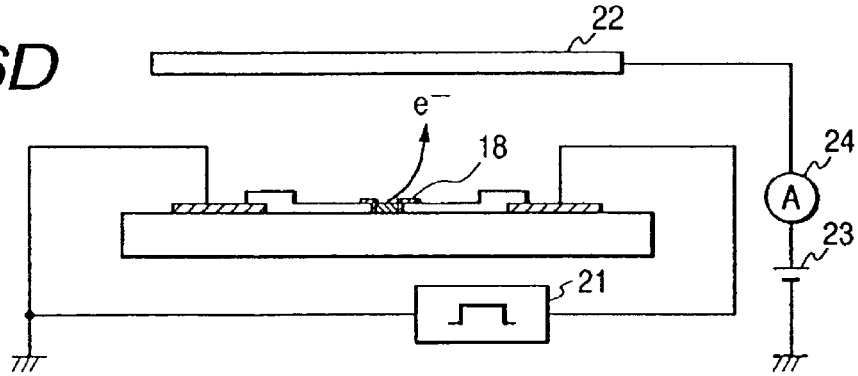

4) Then, an electron emitting characteristic was improved by the energization activating processing, or applying an adequate voltage across the element electrodes 14 and 15 from an activation power source 21 as shown in FIG. 6D.

The energization activating processing is carried out to deposit carbon or carbide in the vicinity of the electron emitting portion 17 formed by the energization forming processing described above by applying a voltage to the electron emitting portion 17 under an appropriate condition. A deposit composed of carbon or carbide is schematically shown as a member 18 in FIG. 6D. The energization activating processing is capable of enhancing an emitting current at the same application voltage typically 100 or more times as high as that before the processing.

Speaking concretely, carbon or carbide obtained from an organic compound existing in a vacuum atmosphere is deposited by applying voltage pulses at regular intervals in a vacuum atmosphere within a range from $10^{-1}$ to $10^{-4}$ Pa. The deposit 18 is made of single-crystal graphite, polycrystalline graphite, non-crystalline carbon or a mixture thereof and has a thickness not larger than 50 nm, more preferably not larger than 30 nm.

Figure 8A:
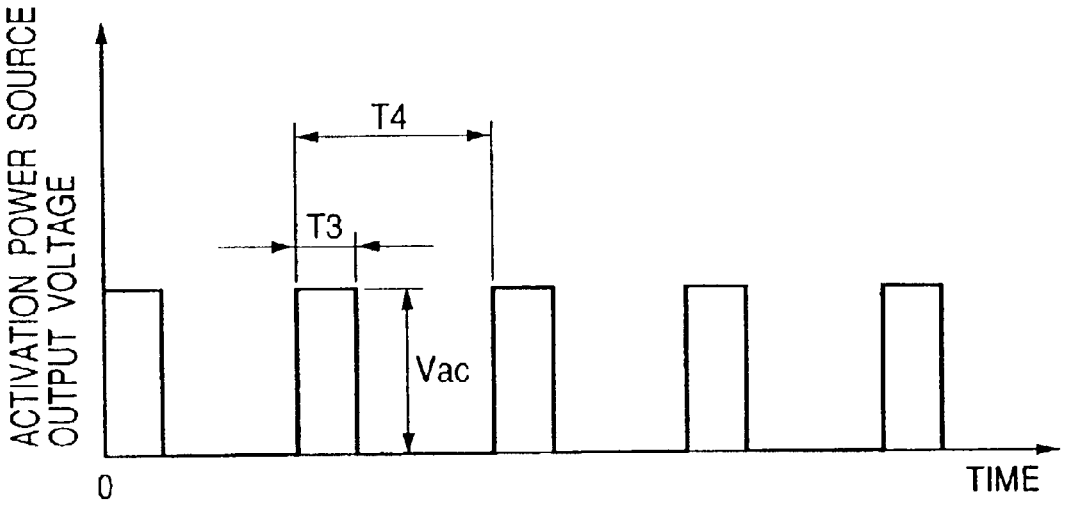
FIGS. 8A and 8B are diagrams illustrating waveforms of pulses applied at a step of energization.

To describe the voltage application method, FIG. 8A exemplifies a waveform of an adequate voltage to be applied from the activation power source 21. In the first embodiment, rectangular waves at a constant voltage were applied for the energization activating processing. Speaking concretely, a voltage Vac of 14V, a pulse width $T_3$ of 1 millisecond and a pulse interval $T_4$ of 10 milliseconds were selected for the rectangular waves. These conditions for the voltage application described above are preferable for the surface conduction type electron emitting element used in the first embodiment and it is desirable to adequately modify the conditions dependently on modifications of the specifications for the surface conduction type electron emitting element.

In FIG. 6D, a reference numeral 22 represents an anode electrode which is disposed to capture a current Ie discharged from the surface conduction type electron emitting element, and connected to a DC high voltage power source 23 and an ammeter 24. When an activating processing is to be carried out after the substrate 13 is assembled in the display panel, a fluorescent surface of the display panel is used as the anode electrode 22.

Figure 8B:
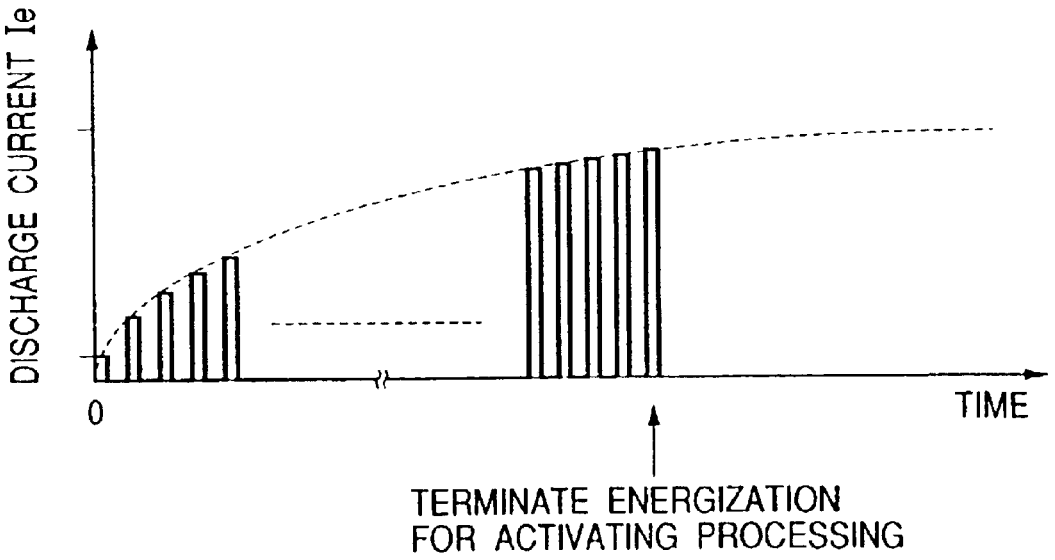

During the voltage application from the activation power source 21, operations of the activating electrode 21 is controlled while measuring the discharge current Ie with the ammeter 24 to monitor a proceeding condition of the energization activating processing. An example of the discharge current Ie measured by the ammeter 24 is shown in FIG. 8B, wherein the discharge current Ie increased with time lapse after starting the pulse voltage application from the activating power source 21, but is soon saturated and not enhanced. At a time when the discharge current Ie is nearly saturated, the voltage application from the activating power source 21 is stopped to terminate the energization activating processing.

The conditions for the voltage application described above are preferable for the surface conduction type electron emitting element used in the first embodiment and it is desirable to adequately modify the conditions dependently on modifications of the specifications for the surface conduction type electron emitting element.

Figure 6E:
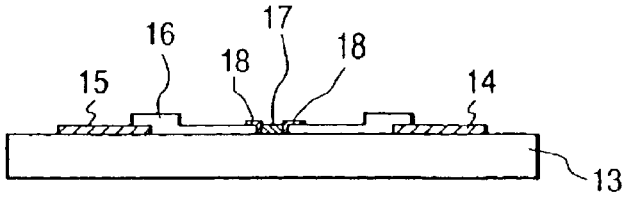

A planar surface type surface conduction electron emitting element shown in FIG. 6E was manufactured as described above.

(Vertical type surface conduction electron emitting element)

Figure 9:
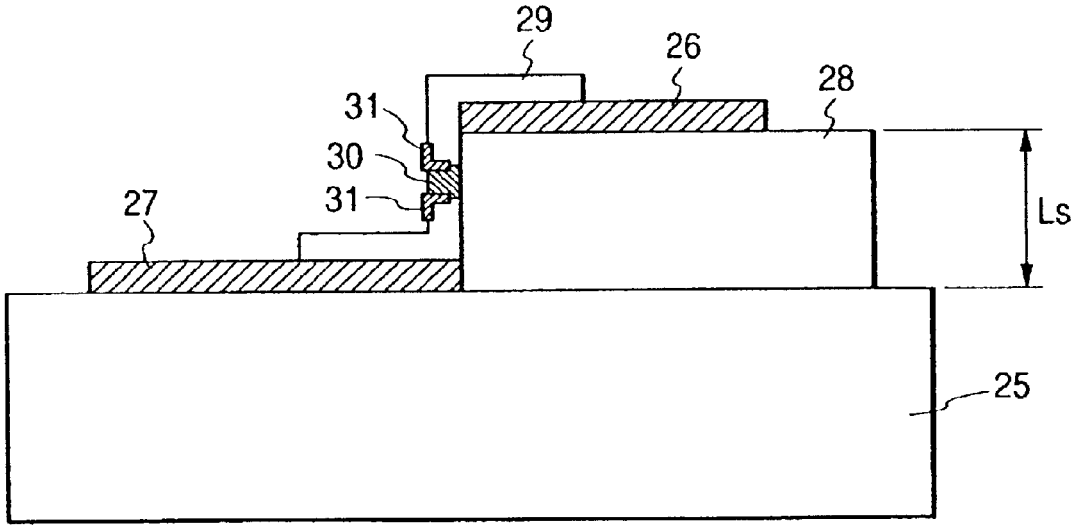
FIG. 9 is a sectional view of a vertical type surface conductive electron emitting element.

FIG. 9 shows a surface conduction type electron emitting element which has another typical configuration, that is, a vertical type surface conduction element emitting element, wherein an electron emitting portion and surroundings thereof are composed of a fine particle film. A schematic sectional view descriptive of a fundamental configuration of the vertical type is shown in FIG. 9, wherein a reference numeral 25 represents a substrate, a reference numerals 26 and 27 designate element electrodes, a reference numeral 28 denotes a step forming member, a reference numeral 29 represents a thin conductive film comprising the fine particle film, a reference numeral 30 designates an electron emitting portion which is formed by the energization forming processing and a reference numeral 31 denotes a thin film which is formed by the energization activating processing.

The vertical type is different from the planar surface type described above in that the element electrode 26 out of the two element electrodes is mounted on the step forming member 28 and the thin conductive film 29 covers a side surface of the step forming member 28. Accordingly, the interval L between the element electrodes in the planar surface type shown in FIGS. 5A and 5B is set as a step height Ls of the step forming member 28 in the vertical type. The substrate 25, the element electrodes 26 and 27, and the thin conductive film 29 composed of the fine particle film may be made of materials which are similar to those mentioned in the description of the planar surface type. An electrically insulating material, for example $SiO_2$, is used for the step forming member 28.

[Characteristics of the surface conduction type electron emitting element used in the image forming system]

Now that configurations and manufacturing methods of the planar surface type and vertical type surface conduction electron emitting elements have been described, explanation will be made of characteristics of the element used in the image forming system.

Figure 10:
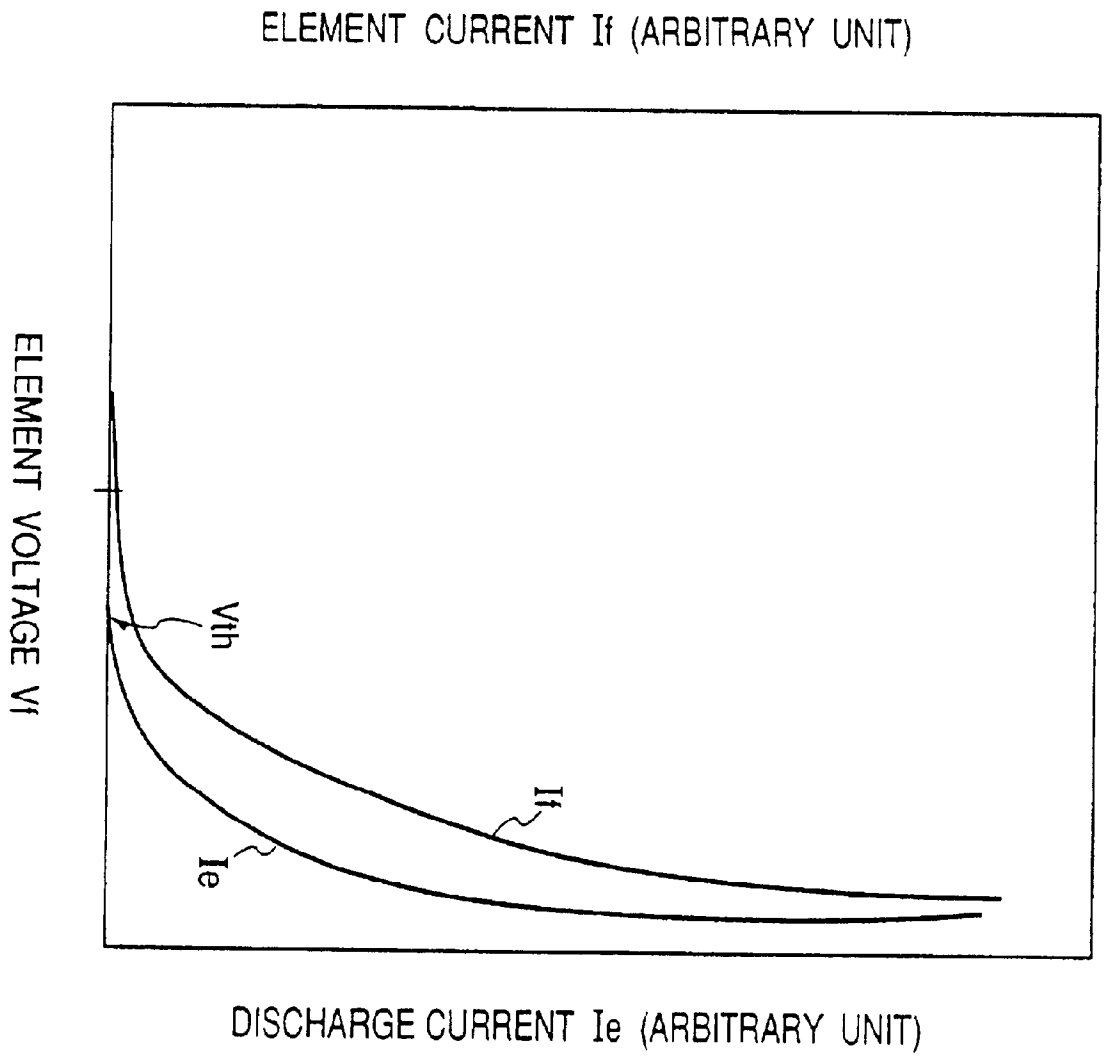
FIG. 10 is a schematic diagram showing current-voltage characteristics of the surface conductive electron emitting element.

FIG. 10 shows typical examples of a characteristic of (discharge current Ie) versus (element application voltage Vf) and a characteristic of (element current If) versus (element application voltage Vf) of the element used in the image forming system. Two graphs were traced in arbitrary units since the discharge current Ie is remarkably lower than the element current If or at a level which makes it difficult to trace these currents on the same scale, and these characteristics are modified dependently on modifications of design parameters such a size and a shape of the element.

The element used in the image forming system has three characteristics described below with regard to the discharge current Ie:

First, the discharge current Ie abruptly increases when a voltage (referred to as a threshold value voltage Vth) is applied to the element, whereas the discharge current Ie is scarcely detected at a voltage lower than the threshold value voltage Vth. That is, the element is a non-linear element which has the threshold value voltage Vth with regard to the discharge current Ie.

Secondly, a level of the discharge current Ie can be controlled with the voltage Vf since the discharge voltage Ie varies dependently on the voltage Vf applied to the element.

Thirdly, an amount of electric charges of electrons discharged from the element can be controlled with the duration of application of voltage Vf since the current Ie discharged from the element has a high response speed to the voltage Vf applied to the element.

Owing to the characteristics described above, the surface conduction type electron emitting element could be used preferably in the image forming system. For example, in the image forming device where numerous elements are provided corresponding to the pixels on the display, by utilizing the first characteristic, it is possible to display an image while progressively scanning the display screen. That is, voltages which are not lower than the threshold value voltage Vth are applied adequately to driven elements dependently on desired brightness and voltages which are lower than the threshold value voltage Vth are applied to elements which are not selected. By progressively switching the driven elements, it is possible to display an image while progressively scanning the display screen.

Gradations can be displayed since it is possible to control emission luminance by utilizing the second or third characteristic.

[Configuration of multi-electron beam source in which a large number of elements are arranged in a simple matrix]

Description will be made of a configuration of a multi-electron beam source in which the surface conduction type electron emitting elements described above are arranged and wired in a simple matrix on a substrate.

Figure 11:
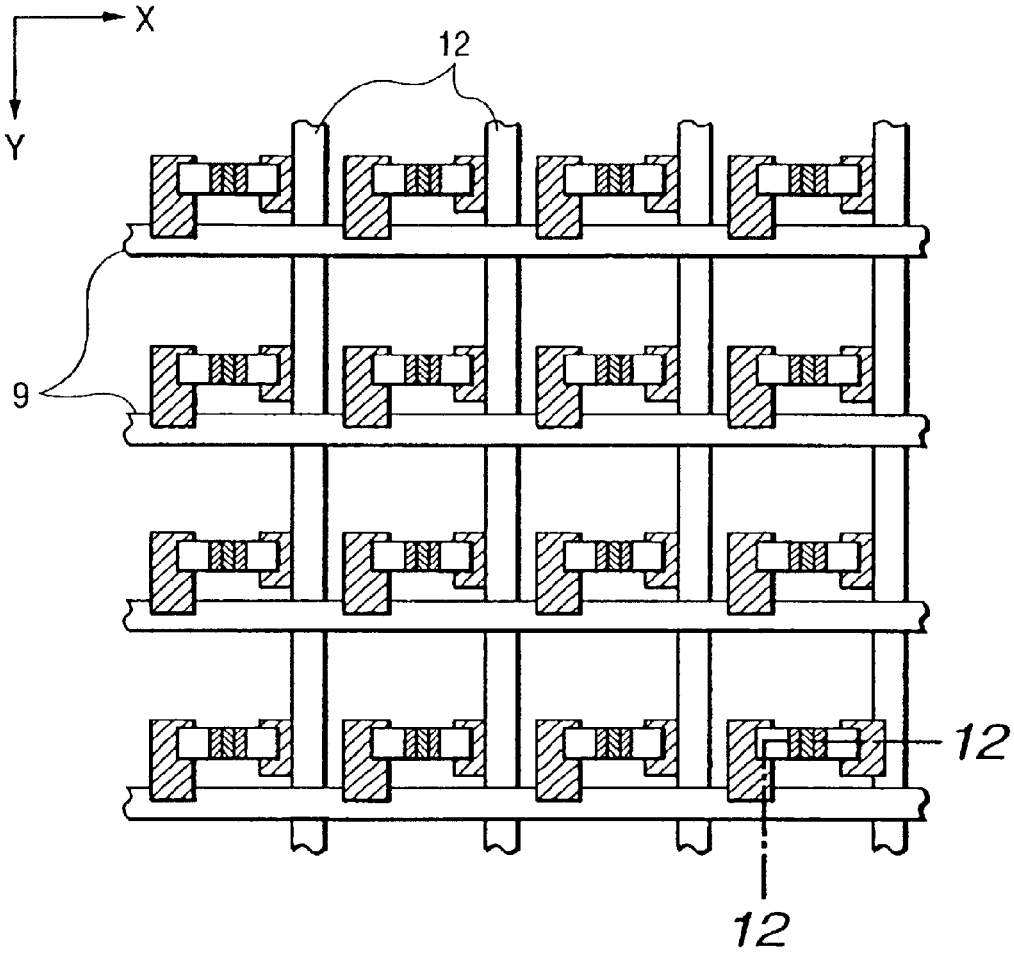
FIG. 11 is a simple matrix type wiring diagram.
Figure 12:
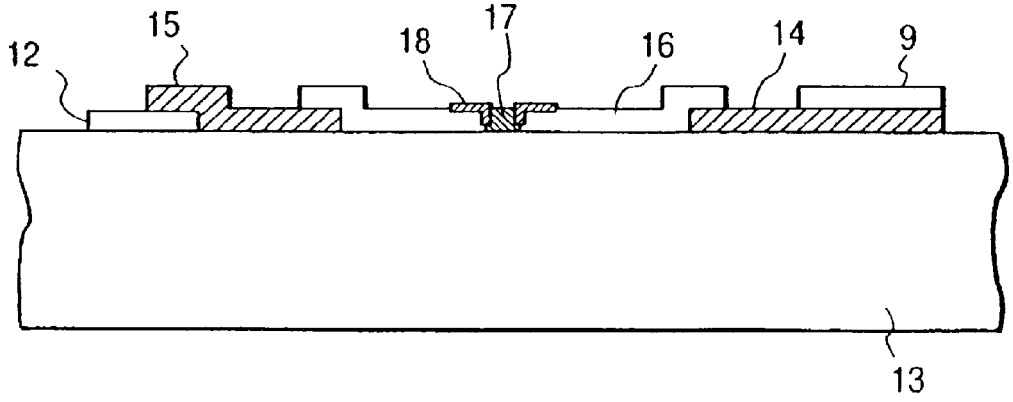
FIG. 12 is a sectional view of the planar surface type surface conductive electron emitting element.

FIG. 11 is a plan view of a multi-electron beam source which is used on the display panel shown in FIGS. 5A and 5B. Surface conduction type electron emitting elements similar to those shown in FIGS. 5A and 5B are arranged on a substrate and wired in a simple matrix by wiring electrodes 9 in the X direction and wiring electrodes 12 in the Y direction. At each intersection between the wiring electrode 9 in the X direction and the wiring electrode 12 in the Y direction, an insulating layer (not shown) is formed between electrodes to maintain electric insulation. A sectional view taken along 12—12 line in FIG. 11 is shown in FIG. 12.

The multi-electron beam source which has the configuration described above was manufactured by preliminarily forming the wiring electrodes 9 in the X direction, the wiring electrodes 12 in the Y direction, an insulating layer between electrodes (not shown), element electrodes of the surface conduction type electron emitting element, and conductive thin film on the substrate, and then performing a power supply energization forming processing and the energization activating processing of each element by way of the wiring electrode 9 in the X direction and the wiring electrode 12 in the Y direction.

Now, the spacer used in the first embodiment will be described with reference to the accompanying drawings.

Description will be made below with reference to FIG. 1. In the first embodiment, a plurality of surface conduction type electron sources 1 which were not formed were formed first on the rear plate 2. Used as the rear plate 2 was a cleaned green glass plate, on which the surface conduction type electron emitting element shown in FIG. 12 was formed in a number of 160×720 in a form of a matrix. The element electrodes 14 and 15 were formed by the Ni sputtering, whereas the wiring electrodes 9 in the X direction and the wiring electrodes 12 were Ag wires formed by the screen printing method. The thin conductive film 16 was a PdO fine particle film obtained by calcining a solution of a Pd amine complex.

Adopted as an image forming member was a fluorescent film 5 on which stripes of fluorescent substances 5*a* in different colors extended in the Y direction as shown in FIG. 4A was, and black belts 5*b* were disposed not only between the fluorescent substances 5*a* but also in the X direction to separate pixels from one another in the Y direction and reserve a space to dispose the spacer 10. The black belts (conductors) 5*b* were formed first and then the fluorescent film 5 was formed by applying the fluorescent substances 5*a* to gaps between the black belts. Selected as a material for the black stripes (black belts 5*b*) was a material which was generally used and contained graphite as a principal component. The fluorescent substances 5*a* were applied to the glass substrate 4 by the slurry method.

After formation of the fluorescent film 5, a smoothing treatment (generally referred to as filming) of an inside surface of the fluorescent film 5 was carried out and then the metal back 6 provided inner than the fluorescent film 5 (electron source side) was formed by vacuum deposition of Al. Though a transparent electrode may be disposed in face plate 7 outside the fluorescent film 5 (between the glass substrate and the fluorescent film) to enhance a conductivity of the fluorescent film 5, such a transparent electrode was omitted in the first embodiment wherein a sufficient conductivity of the fluorescent film 5 was obtained only with the metal back.

The spacer 10 was formed by forming a film of silicon nitride 0.5 $\mu$m as an Na blocking layer 10*b* on an insulating substrate 10*a* (3.8 mm high by 200 $\mu$m thick by 200 mm long) composed of a cleaned soda lime glass sheet, and forming nitride film 10*c* of Cr and Ge on the Na blocking layer 10*b* by a vacuum film forming method.

The nitride film of Cr and Ge used in the first embodiment was formed by sputtering targets of Cr and Ge at the same time in a mixture atmosphere of argon and nitrogen using a sputtering system.

Figure 13:
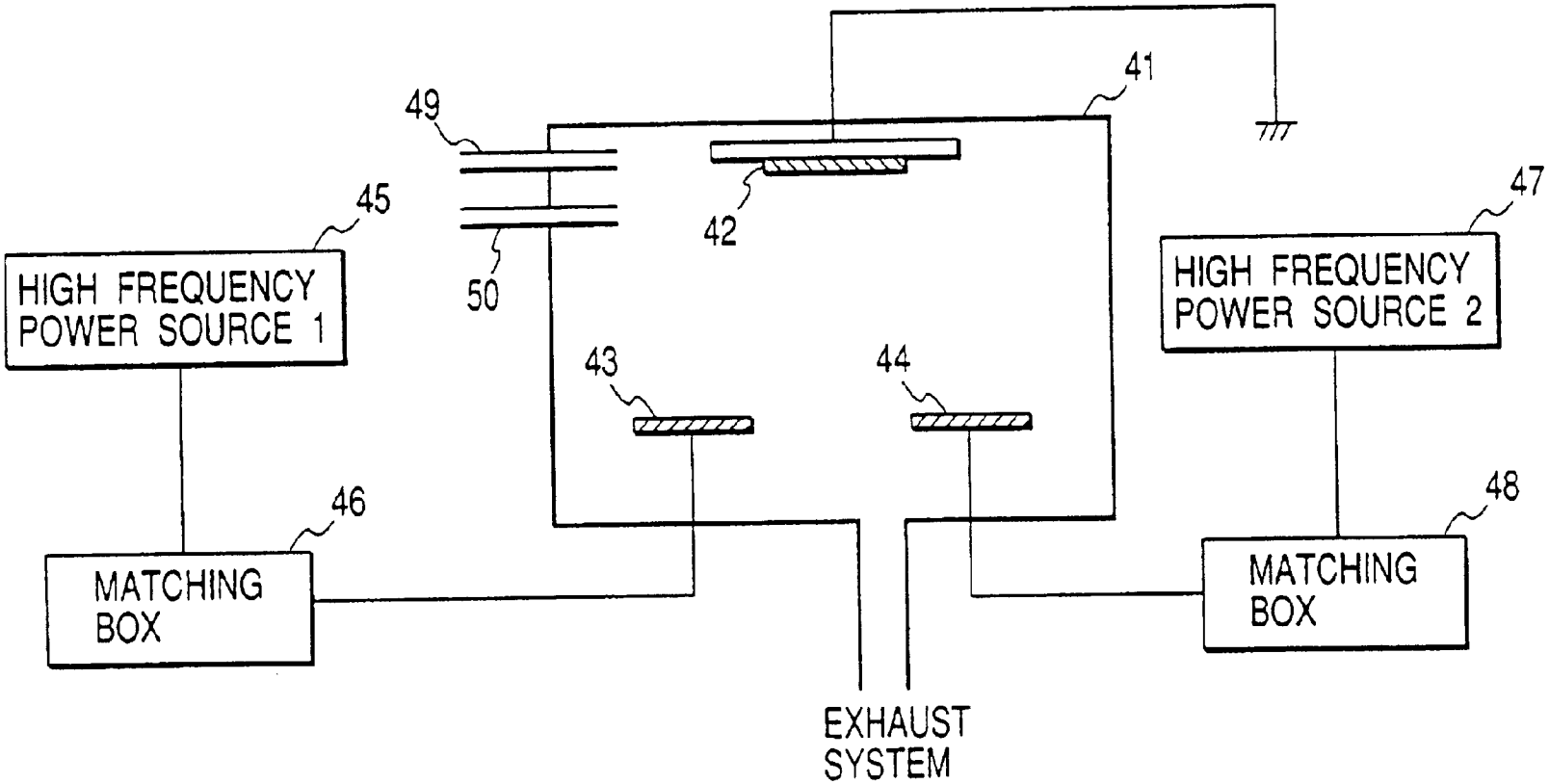
FIG. 13 is a block diagram schematically showing a configuration of a sputtering device.
Figure 14:
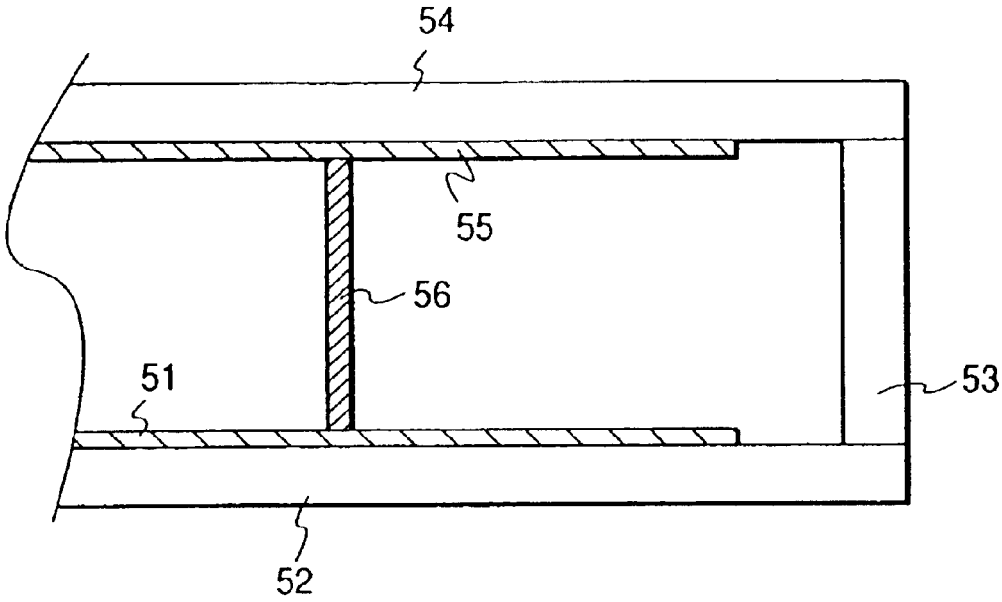
FIG. 14 is a schematic sectional view of a display which uses a large number of fine electron sources.

The sputtering system was configured as shown in FIG. 13. In FIG. 13, a reference numeral 41 represents a sputtering chamber, a reference numeral 42 designates a spacer member, reference numerals 43 and 44 denote the targets of Cr and Ge respectively, reference numerals 45 and 47 represent high frequency power sources which apply high-frequency voltages to the targets 43 and 44 respectively, reference numerals 46 and 48 designate matching boxes, and reference numerals 49 and 50 denote introduction pipes to introduce argon and nitrogen.

A back pressure was $2\times10^{-5}$ Pa in the sputtering chamber. A mixture gas of argon and nitrogen was flowed to keep a partial pressure of nitrogen at 30% during the sputtering. A total pressure of the sputtering gas was 0.45 Pa. The nitride film of Cr and Ge was formed by applying high-frequency voltages of 13 W and 15 W to the Cr target and the Ge target respectively, and adjusting a sputtering time.

Three kinds of nitride films of Cr and Ge were manufactured: a film 45 nm thick having specific resistance of 2.5 Ωm as depo, a film 200 nm thick having specific resistance of $3.5\times10^{3}$ Ωm as depo and a film 80 nm thick having specific resistance of $5.2\times10^{6}$ Ωm as depo.

The resistance of the spacer (for withstanding atmospheric pressure) is measured according to a method as follows:

The spacer contacts electrodes at both sides (one end at the face plate side and the other at the rear plate side), or at sections in the vicinity of the ends. Then, D.C. voltage Vi (100V) is supplied thereto so that an electric field is applied in the same direction as that at mounting it within the display. Within the atmosphere is at a pressure lower than $10^{-5}$ Torr, it is shielded from light, at temperature 20° C., the measurement was performed. As the electrodes contact the spacer, stainless steel plate mirror polished by electrolytic polishing is used, in a manner that the spacer was sandwiched between pair of the stainless steel plates. Alternately, probe electrode may be used in a manner that the probe electrode contacts both ends of the spacer or in the vicinity thereof. In case of measurement wherein the spacer is mounted within the display device, the ends of the spacer pushes the panel of the display device. In order to prevent such pushing, the probe contacts, in the vicinity of spacer end, the wiring or metal back which is a conductive member for conducting to the spacer end. The wiring or the metal back has a resistance sufficiently lower than the resistance of the spacer. There was no problem even if the electrode for measurement does not contact directly to the spacer end.

Thus, a current Ii flowing between the measurement electrodes is measured. According to a following generalized equation (1), the resistance Ri of the spacer is calculated:

$$Ri=Vi/Ii[\Omega] \quad (1)$$

Based on the sheet resistance Ri of the spacer, a sheet resistance Rsi and a volume resistance ρi are calculated from following equations (2) and (3):

$$Rsi=Ri\times w/d[\Omega/\square] \quad (2)$$

$$\rho i=Ri\times s/d[\Omega cm \quad (3)$$

While, s is a sectional area ($cm^2$) of a current path of a current flowing into the spacer, when a high resistance film covers the surface thereof, the sectional are coincides with a sectional area of the high resistance film.

While, d is a current path length (cm), when the electrode is formed at a position at which the spacer is bonded, it coincides with a distance between the spacer and the electrode.

Further, w is a width (cm) of the current path when a thickness of the high resistance film is t (cm), the width coincides with s/t.

The above measured voltage can be measured under a condition of practical usage, by increasing it into a level of anode voltage (e.g. several kV) according to necessity within a range lower than a discharge voltage of a measurement member.

An electrode 11 was disposed on a connecting portion of the spacer 10 to ensure electrical connections to the wires 9 in the X direction and the metal back 6. This electrode 11 completely covered four surfaces of the spacer 10 which were exposed in the enclosure 8 within a range of 50 μm as measured from the wires in the X direction toward the face plate and 300 μm as measured from the metal back toward the rear plate. However, the electrode 11 may not be disposed when the electrical connections of the spacer 10 can be secured without the electrode 11. The spacers 10 on which the nitride films 10*c* of Cr and Ge were formed as the electrification moderating films 10*c* were fixed at equal intervals to the wires 9 in the X direction on the face plate 7.

Subsequently, the face plate 7 was disposed 3.8 mm over the electron source 1 by way of the support frame 3, and seams among the rear plate 2, the face plate 7, the support frame 3 and the spacer 10 were fixed.

Frit glass was applied to the seam between the rear plate 2 and the support frame 3 and the seam between the face plate 7 and the support frame 3 (a conductive frit glass was applied to the seam between the spacer and the face plate), and these seams were sealed by calcining the frit glass at 430° C. for 10 minutes or longer in nitrogen gas so that the nitride film of germanium and the transition metal on the surface of the spacer was not oxidized.

Conductivity between the electrification moderating film and the face plate was secured for the spacer 10 by using a conductive frit glass which contained silica balls coated with Au on the black belts 5*b* (300 μm wide) on the face plate 7. The metal back was partially removed in an area where the metal back is in contact with the spacer.

After the enclosure 8 completed as described above is evacuated to a sufficiently low pressure by discharging atmosphere from the enclosure with a vacuum pump through an exhaust pipe, the electron emitting portion 17 was formed by applying a voltage across the element electrodes 14 and 15 of the electron emitting element 1 by way of the external terminals $D_{xl}$ through $D_{xm}$ and $D_{yl}$ through $D_{yn}$ of the vessel for the voltage application process (forming processing) of the thin conductive film 16. The forming processing was performed by applying voltage with a waveform shown in FIG. 7.

Then, the energization activating processing was carried out to deposit carbon or carbide by introducing acetone into a vacuum vessel through the discharging pipe to a pressure of 0.133 Pa and applying voltage pulses to the external terminals $D_{xl}$ through $D_{Xm}$ and $D_{yl}$ through $D_{yn}$ of the vessel at regular intervals. The energization activating processing was carried out by applying a voltage which had waveforms such as those shown in FIGS. 5A and 8B.

After the vessel was evacuated for 10 hours while heating it as a whole at 200° C., the exhaust pipe was soldered by heating it with a gas burner at a pressure on the order of $10^{-4}$ Pa, thereby sealing the enclosure 8.

Finally, a getter processing was carried out to maintain a pressure after the sealing.

An image was displayed on the image forming system which was completed as described above by applying scanning signals and modulation signals from signal generators (not shown) to the electron emitting elements 1 by way of the external terminals $D_{xl}$ through $D_{xm}$ and $D_{yl}$ through $D_{yn}$ of the enclosure to emit electrons and applying a high voltage to the metal back 6 by way of the high voltage terminal Hv to accelerate emitted electron beams, and bombarding the fluorescent film 5 with the electrons to excite and glow the fluorescent substances. The application voltage Va to the high voltage terminal Hv was set at 1 kV to 5 kV, and the application voltage Vf across the element electrodes 14 and 15 was set at 14V.

Resistance values of the electrification moderating film 10*c* of the spacer 10 which were measured before assembling, after the sealing of the face plate, after the sealing of the rear plate, after the evacuation and after the energization forming of the element electrodes remained substantially unchanged. This fact indicates that the nitride film of Cr and Ge is highly stable and suited for use as the electrification moderating film.

On the spacer which had the specific resistance of $3.5\times10^3$ Ωm glowing spots including those formed by electrons emitted from electron emitting elements 1 which were disposed at locations near the spacer were formed in two dimensions in rows at equal intervals, thereby making it possible to display a clear image with a high reproducibility. This fact indicates that the spacer 10 which was disposed in position did not disturb an electric field to result in an influence on orbits of the electrons and was not electrified. The material of the spacer had a thermal coefficient of resistance of −0.8% and did not allow the thermal runaway even at a voltage level of Va=5 kV.

The spacer which had the specific resistance of 2.5 Ωm allowed voltages up to 2 kV though power consumption attained nearly to 1 w at Va=2 kV. The spacer which had the high specific resistance of $5.2\times10^6$ Ωm exhibited a low electrification preventive effect and allowed an image to be disturbed in the vicinity of the spacer by an electron beam attracted by the spacer though it did not cause the thermal runaway and was capable of displaying the image.

XPS (x-ray photoelectron spectrometry) of nitrization ratios (atomic concentrations of germanium composing germanium nitride/atomic concentrations of germanium) of the spacers indicated 70, 65 and 58%.

Comparative Example

As a comparative example, a conductive film was formed by a method similar to that described above using $SnO_2$ in place of the nitride film of Cr and Ge (resistance value $6.7\times10^8$ Ω as depo, thickness 5 nm). Sputtering was carried out using the sputtering system shown in FIG. 13 and an $SnO_2$ target in place of a metal target. The film was formed for 5 minutes using argon at a total pressure of 0.5 Pa and while applying a voltage of 500 W.

A resistance value of the conductive film 10*c* was remarkably varied at an assembling step. After completing the assembling step, specific resistance was $9.2\times10^{-2}$ Ωm and resistance value was $1.8\times10^6$ Ω, thereby making it impossible to enhance the voltage Va up to 1 kV. That is, the comparative example allowed resistance to be varied remarkably and at inconstant rates at a stage to manufacture a spacer, thereby allowing resistance to be remarkably variable after manufacturing or incapable of controlling resistance with precision. Furthermore, the specific resistance value of $SnO_2$ obliged to form a film to have an extremely small thickness not larger than 1 nm, thereby making it more difficult to control resistance.

Second Embodiment

Different from the first embodiment, the second embodiment used a nitride film of Ta and Ge in place of the nitride film 10*c* of Cr and Ge of the spacer 10. The nitride film of Ta and Ge used in the second embodiment was formed by sputtering a Ta target and a Ge target at the same time in a mixture atmosphere of argon and nitrogen using a sputtering system. The sputtering system was that shown in FIG. 13. A sputtering chamber had a back pressure of $2\times10^{-5}$ Pa. A mixture gas of argon and nitrogen was flowed during the sputtering to keep a partial pressure of nitrogen at 30%. The sputtering gas had a total pressure of 0.45 Pa. The nitrogen film of Ta and Ge was formed by applying a high-frequency voltage of 150 W to each of the Ta target and the Ge target while adjusting a sputtering time.

The nitride film 10*c* of Ta and Ge formed as described above had a thickness of approximately 200 nm and specific resistance of $8.4\times10^3$ Ωm. The film had a thermal coefficient of resisteance of −0.6%.

An image forming system was manufactured using the spacer 10 described above and evaluated like the first embodiment. An application voltage Va to the high voltage terminal Hv was set at 1 kV to 5 kV, and an application voltage Vf across element electrodes 14 and 15 was 14 kV.

Resistance values of the spacer which were measured before assembling the spacer (as depo), after sealing it to a face plate, after sealing it to a rear plate, after evacuating it and energization forming the element electrodes remained substantially the same throughout all the assembling steps.

Furthermore, measurements of resistance values of minute portions of the spacer 10 from the vicinities of the rear plate to the vicinities of the face plate indicated no locational variation even after completing all the assembling steps and the film had a uniform resistance value as a whole. Glowing spots including those which were formed by electrons emitted from electron emitting elements 1 which were disposed at locations near the spacer 10 were formed in two dimensions at equal intervals, thereby making it possible to display a clear color image with a high reproducibility. This fact indicated that the spacer 10 did not cause such a disturbance as to produce influences on orbits of the electrons and that the spacer 10 was not electrified.

Third Embodiment

The third embodiment used a nitride film of Ti and Ge in place of the nitride film of Cr and Ge used in the first embodiment. The nitride film of Ti and Ge used in the third embodiment was formed by sputtering targets of Ti and Ge at the same time in a mixture atmosphere of argon and nitrogen using a sputtering system. The sputtering system was that shown in FIG. 13. The sputtering chamber had a back pressure of $2\times10^{-5}$ Pa. During the sputtering, a mixture gas of argon and nitrogen was flowed to keep a partial pressure of nitrogen at 30%. A total pressure of the sputter gas was 0.45 Pa. The nitride film of Ti and Ge was formed by applying high-frequency voltages of 120 W and 150 W to the Ti target and the Ge target respectively while adjusting a sputtering time.

Nitride films 10*c* of Ti and Ge were manufactured in two kinds: one which was approximately 60 nm thick and had specific resistance of $7.4\times10^3$ Ωm, and the other which was approximately 80 nm thick and had specific resistance of $2.2\times10^5$ Ωm. A thermal coefficient of resistance was −0.8%.

An image was displayed on an image forming system which used the spacer 10 described above by applying scanning signals and modulation signals from signal generators (not shown) to the electron emitting elements 1 by way of external terminals $D_{xl}$ through $D_{xm}$ and $D_{xl}$ through $D_{yn}$ of a vessel to emit electrons, applying a high voltage to the metal back 6 by way of the high voltage terminal Hv to accelerate the emitted electron beams, bombarding the fluorescent film 5 with the electrons to excite and glow the fluorescent film.

An application voltage Va to the high voltage terminal Hv was set at 1 kV to 5 kV and an application voltage Vf across the element electrodes 14 and 15 was set at 14 V.

Resistance values which were measured before assembling the spacer (as depo), after sealing it to the face plate, after sealing it to the rear plate, after evacuating it and after energization forming the element electrodes were free from extreme variations though the resistance values were enlarged through all the assembling steps.

Measurements of resistance values of minute portions of the spacer 10 from the vicinities of the rear plate to the vicinities of the face plate indicated no locational variation even after completing all the assembling steps and the film had a uniform resistance value as a whole. When the spacer having the specific resistance of $7.4\times10^3$ Ωm was used, glowing spots including those which were formed by electrons emitted from electron emitting elements 1 which were disposed at locations near the spacer were formed in two dimensions at equal intervals, thereby making it possible to display a clear image with a high reproducibility. This fact indicates that the spacer 10 did not cause such a disturbance as to produce influences on orbits of the electrons and that the spacer 10 was not electrified. When the spacer which had the higher specific resistance ($2.2\times10^5$ Ωm) was used, on the other hand, electron beams were deflected in the vicinities of the spacer, thereby slightly disturbing an image.

Fourth Embodiment

The fourth embodiment used a nitride film of Mo and Ge in place of the nitride film of Cr and Ge 10*c* of the spacer 10 used in the first embodiment. The nitride film of Mo and Ge used in the fourth embodiment was formed by sputtering targets of Mo and Ge at the same time in a mixture atmosphere of argon and nitrogen using a sputtering system. The sputtering system was that shown in FIG. 13. A sputtering chamber had a back pressure of $2\times10^{-5}$ Pa. During the sputtering, a mixture gas of argon and nitrogen was flowed to keep a partial pressure nitrogen at 30%. A total pressure of the sputtering gas was 0.45 Pa. The nitride film of Mo and Ge was formed by high-frequency voltages of 15 W and 150 W to the Mo target and the Ge target respectively while adjusting a sputtering time.

A nitride film of Mo and Ge thus formed was approximately 200 nm thick and had specific resistance of $6.4\times10^3$ Ωm. A thermal coefficient of resistance was −0.6%.

An image forming system was manufactured using the spacer 10 described above and evaluated for the image as in the first embodiment.

The application voltage Va to the high voltage terminal Hv was set at 1 kV to 5 kV and the application voltage Vf across the element electrodes 14 and 15 was set at 14 V.

Resistance values of the spacer which were measured before assembling the spacer (as depo), after sealing it to the face plate, after sealing it to the rear plate, after evacuating it and after energization forming the element electrodes remained substantially unchanged throughout all the assembling steps.

Furthermore, measurements of resistance values of minute portions of the spacer 10 from the vicinities of the rear plate to the vicinities of the face plate indicated no locational variation even after completing all the assembling steps and the film had a uniform resistance value as a whole. Glowing spots including those which were formed by electrons emitted from the electron emitting elements 1 which were disposed at locations near the spacer 10 were formed in rows at equal intervals in two dimensions, thereby allowing a clear image to be formed with a high reproducibility. This fact indicated that the spacer 10 did not cause such a disturbance as to produce influences on orbits of the electrons and that the spacer 10 was not electrified.

Fifth Embodiment

The fifth embodiment used a film of W and Ge compound in place of the nitride film of Cr and Ge 10*c* which was used in the first embodiment. The nitride film of W and Ge used in the fifth embodiment was formed by sputtering a W target and a Ge target at the same time in a mixed atmosphere of argon and nitrogen using a sputtering system. The sputtering system was that shown in FIG. 13. The sputtering chamber has a back pressure of $2\times10^{-5}$ Pa. During the sputtering, a mixture gas of argon and nitrogen was flowed to keep a partial pressure of nitrogen at 30%. The sputtering gas had a total pressure of 0.45 Pa. The nitride film of W and Ge was formed by applying high-frequency voltages of 12 W and 150 W to the W target and the Ge target respectively while adjusting a sputtering time.

A nitride film of W and Ge 10*c* thus formed was approximately 200 nm thick and had specific resistance of $5.0\times10^3$ Ωm. The nitride film had a thermal coefficient of resistance of −0.4%.

An image forming system was manufactured using a spacer 10 having the nitride film described above and evaluated as in the first embodiment.

The application voltage Va to the high voltage terminal Hv was set at 1 kV to 5 kv, and the application voltage Vf across the element electrodes 14 and 15 was set at 14 V.

Resistance values of the spacer which were measured before assembling the spacer (as depo), after sealing it to the face plate, after sealing it to the rear plate, after evacuating it and after energization forming the element electrodes remained substantially unchanged throughout all the assembling steps.

Furthermore, measurements of resistance values of minute portions of the spacer 10 from the vicinities of the rear plate to the vicinities of the face plate indicated no locational variation and the film had a uniform resistance value as a whole even after completing all the assembling steps. Glowing spots including those which were formed by electrons emitted from the electron emitting elements 1 which were disposed at locations near the spacer 10*c* were formed at equal intervals in two dimensions, thereby allowing a clear image to be displayed with a high reproducibility. This fact indicated that the spacer 10 did not cause such a disturbance as to produced influences on orbits of the electrons and that the spacer 10 was not electrified.

Sixth Embodiment

The sixth embodiment used as electron emitting elements field emission type elements which are a kind of cold-cathode emission elements.

Figure 16:
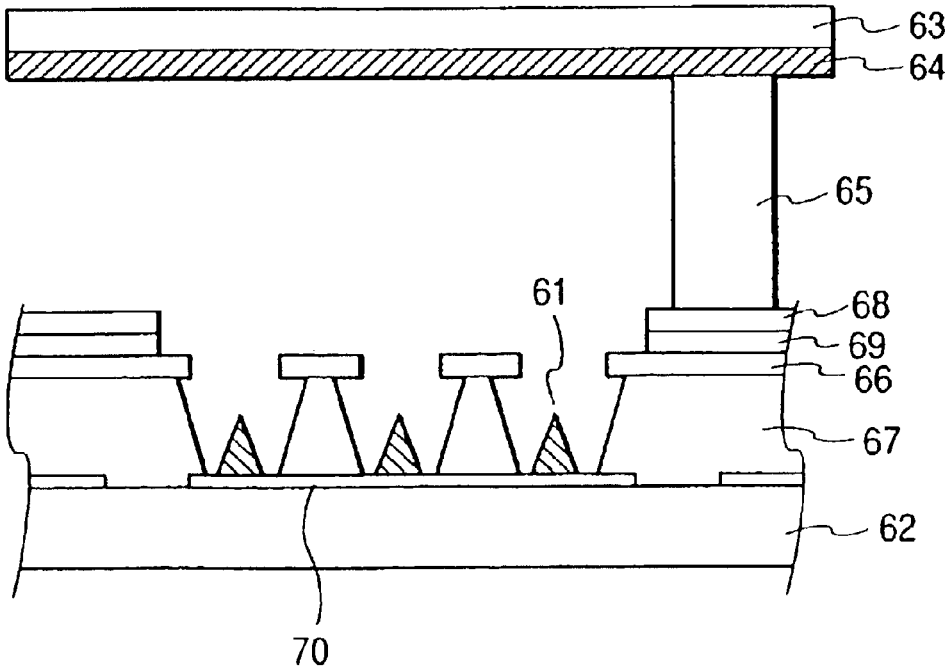
FIG. 16 is a schematic sectional view of an image forming system preferred as a sixth embodiment illustrating mainly a spacer and electron sources.

FIG. 16 is a schematic sectional view showing mainly a spacer and an electron source of an image forming system preferred as the sixth embodiment. In FIG. 16, a reference numeral 62 represents a rear plate, a reference numeral 63 designates a face plate, a reference numeral 61 denotes a cathode, a reference numeral 66 represents a gate electrode, a reference numeral 67 designates an insulating layer between the gate electrode and the cathode, a reference numeral 68 denotes a focusing electrode, a reference numeral 64 represents a fluorescent substance, a reference numeral 69 designates an insulating layer between the focusing electrode and the gate electrode, and a reference numeral 70 denotes a wire for the cathode. A reference numeral 65 represents a spacer which is composed of an insulating substrate which is covered with a nitride film of tungsten and germanium formed by the sputtering method.

The electron emitting elements function to emit electrons from a tip of the cathode 61 when a high voltage is applied across the tip of the cathode 61 and the gate electrode 66. The gate electrode 66 has an electron passing port to allow electrons emitted from a plurality of cathodes to pass through the gate electrode 66. Electrons which have passed through the port of the gate electrode are focused by the focusing electrode 68, accelerated by an electric field produced by an anode disposed on the face plate 63 and bombard pixels of the fluorescent substance corresponding to the cathode to glow the fluorescent substance. A plurality of gate electrodes 66 and a plurality of cathode wires 70 are arranged in a matrix so that a cathode is selected by an input signal and electrons are emitted from the selected cathode.

The cathodes, the gate electrode, the focusing electrode, the wires for cathodes and son on are manufactured by known methods, and the cathodes are made of Mo. The spacer substrate is composed of a green glass plate 200 mm long by 3.8 mm wide by 0.2 mm thick, and a nitride film of tungsten and germanium 200 nm thick is formed on the spacer substrate by a method similar to those used in the fifth embodiment. The spacer 65 is cemented to the focusing electrode 68 with a conductive frit glass material. To lower contact resistance, an aluminium film 100 $\mu$m thick is deposited on a portion of the spacer 65 which is to be brought into contact with the focusing electrode or the fluorescent substance.

The nitride film of tungsten and germanium and the spacer used in the sixth embodiment had specific resistance values of $7.9\times10^3$ Ωm and $3.7\times10^9$ Ωm respectively.

After cementing the spacer to the rear plate 62 and forming a layer of the fluorescent substance 64 on the face plate 63, the rear plate 62 and the face plate 63 were positioned and sealed each other with frit glass in nitrogen atmosphere, thereby manufacturing an airtight vessel. An interior of this airtight vessel was baked at 250° C. for 10 hours while evacuating it though an exhaust pipe. Then, the airtight vessel was evacuated to $10^{-5}$ Pa and sealed by soldering the exhaust pipe with a gas burner. Finally, a getter processing was carried out by a high-frequency heating method to maintain a vacuum pressure after the sealing.

An image was formed on an image forming system manufactured as described above by applying signals from a signal generator (not shown) to the cathode 61 by way of an external terminal of the vessel to emit electrons and irradiating the fluorescent substance 64 with the electrons while applying a high voltage to a transparent electrode formed on the face plate.

After manufacturing steps of the image forming system, the spacer had a stable resistance value of $4.2\times10^9$ Ω and no deviation of electron beams was not recognized in the vicinities of the spacer.

The electrification moderating film described above allows its resistance to be varied little even in an atmosphere of oxygen or the like and need not be formed in an island-like pattern or extremely thin even when it has high resistance, thereby featuring excellent stability and reproducibility. Furthermore, the electrification moderating film has a high melting point and high hardness, thereby exhibiting a merit of high stability. Furthermore, an optional resistance value is obtainable by adjusting a composition of the electrification moderating film since germanium nitride is an insulating material and a nitride of a transition metal is a good conductor. The electrification moderating film according to the present invention is applicable not only the image forming systems described as the embodiments but also CRTs and electronic tubes such as discharge tubes and widely usable in fields where electrification is problematic.

Furthermore, the image forming system according to the present invention, which uses a nitride film of a transition metal and germanium as an electrification moderating film on a surface of an insulating member interposed between an element substrate and a face plate, scarcely allows resistance to be varied during assembling steps and is capable of obtaining a stable resistance value. Accordingly, the image forming system according to the present invention is capable of suppressing disturbance of beam potentials in the vicinities of a spacer, preventing locations of beams bombarding fluorescent substances from deviating locations of the fluorescent substances which are originally to be glowed and hindering luminance loss, thereby displaying clear images.

Seventh Embodiment

Description will be made below of embodiments which use electrification moderating films (referred also as electrification preventive films) additionally containing Al.

[Method to Calibrate Film Surface Composition]

At a stage to determine film surface compositions such as a surface nitrization ratios of a spacer, a system which is described below is used for calibration. Using a system which is equipped with a thin film forming mechanism, an RHEED (reflected high-speed electron diffraction pattern analyzer) and an XPS (X-ray photoelectron spectroscope) in a vacuum chamber kept at a vacuum degree not higher than $10^{-8}$ Pa, a nitride film was formed with the thin film forming mechanism and an XPS measurement was conducted after confirming formation of an AIN by the RHEED method. Using peak area ratios of an A12p spectrum and an Nls spectrum, a surface composition of a nitride film of transition metal alloy of aluminium and germanium was calibrated.

Seventh through eleventh embodiments used electrification preventive films 10*c* which were nitride films of transition metal of aluminium and germanium alloys, and, for example, Cr, Ti, Ta, Mo and W were used as transition metals.

It is preferable to select:

a ratio Cr/(Al+Ge) of 5 at. % to 18 at. % (atomic %)

a ratio Ti/(Al+Ge) of 24 at/ % to 40 at. % (atomic %)

a ratio Ta/(Al+Ge) of 36 at. % to 50 at. % (atomic %)

a ratio Mo/(Al+Ge) of 3 at. % to 18 at. % (atomic %)

a ratio of W/(Al+Ge) of 3 at. % to 20 at. % (atomic %)

Now, description will be made of a concrete configuration of the embodiment 7.

A spacer 10 was manufactured by forming a silicon nitride film 0.5 $\mu$m thick as an Na blocking layer 10*b* on a planar insulating substrate 10*a* composed of soda lime glass sheet (3.8 mm high by 200 $\mu$m thick by 200 mm long) and forming a nitride film 10*c* of an alloy of Cr, Al and Ge on the Na blocking layer 10*b* by the vacuum film forming method.

The nitride film 10*c* of the alloy of Cr, Al and Ge used in the seventh embodiment was formed by sputtering targets of Cr, Al and Ge at the same time in a mixture atmosphere of argon and nitrogen using a sputtering system. Compositions were adjusted by varying powers applied to the targets, thereby obtaining optimum resistance.

Describing in detail, pressures and power for the gases were:

Ar=2.4 mTorr/$N_2$=0.6 mTorr, Cr=18 W, Al=600 W and Ge=45 W. The substrate was kept at room temperature and grounded.

Figure 17:
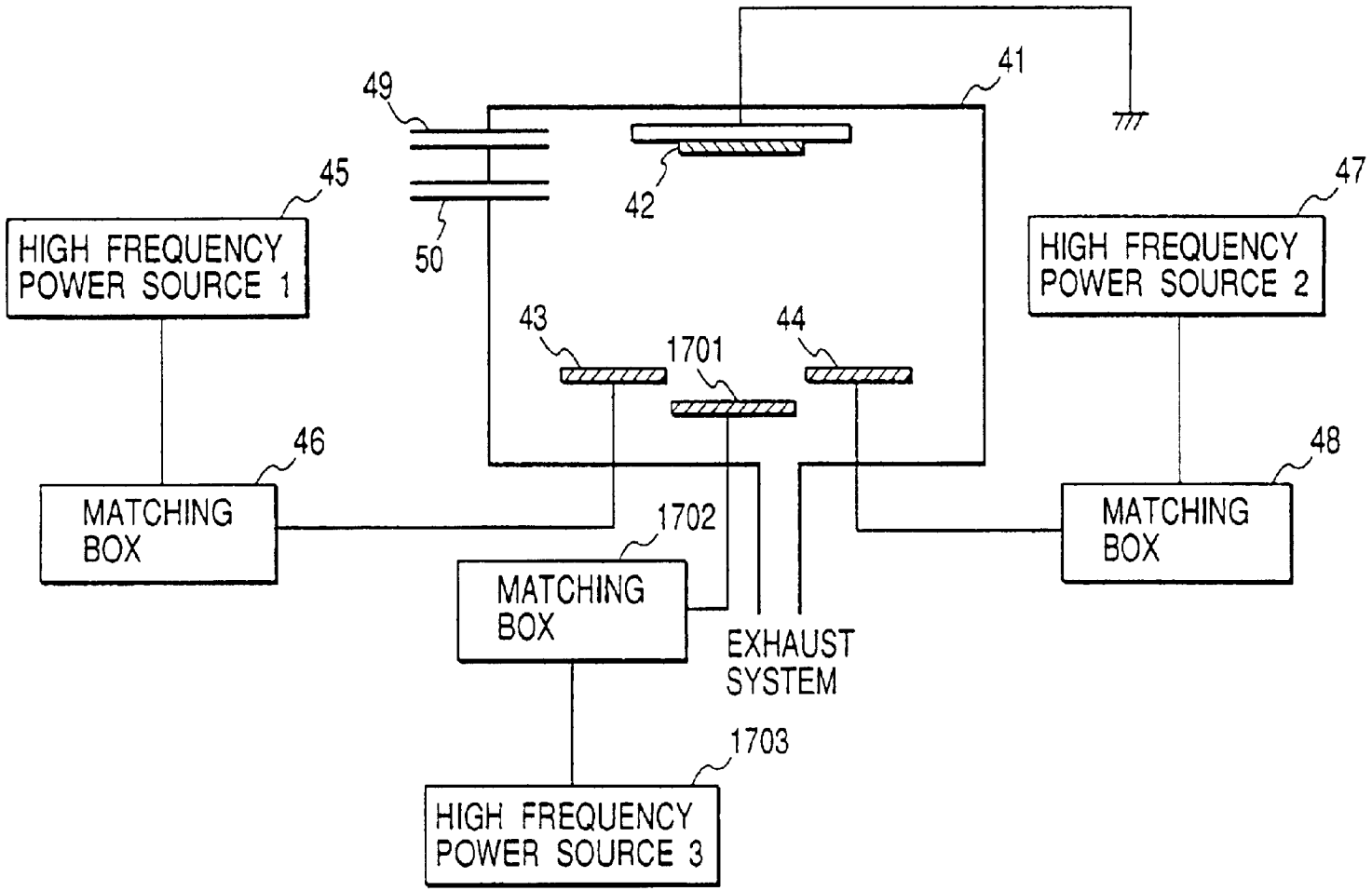
FIG. 17 is a block diagram schematically showing a configuration of a sputtering device used in embodiments 7 to 11.

The sputtering system is shown in FIG. 17. In FIG. 17, a reference numeral 41 represents a film forming chamber, a reference numeral 42 designates a spacer member, reference numerals 43, 44 and 1701 denote targets of Cr, Al and Ge respectively, reference numerals 45, 47 and 1703 represent high-frequency power sources to apply high-frequency voltages to the targets 43, 44 and 1701 respectively, reference numerals 46, 48 and 1702 designate matching boxes to match impedance, and reference numerals 49 and 50 denote inlet pipes to introduce nitrogen. The sputtering was carried out by introducing argon and nitrogen into the film forming chamber 41 at the partial pressured specified above, and applying a high-frequency voltage across the targets 43, 44, 1701 and the spacer member 42 for electric discharge.

The nitride film of the alloy of Cr, Al and Ge was 200 nm thick, and had specific resistance of $2.4\times10^3$ Ωm, a Cr/(Al+Ge) composition ratio of 7 at. % (atomic %) and a Ge/Al composition ratio of 18 at. % (atomic %).

An image was displayed on an image forming system which was manufactured as in the first embodiment by applying scanning signals and modulation signals from signal generators (not shown) by way the external terminals $D_{xl}$ through $D_{xm}$ and $D_{yl}$ through $D_{yn}$ to the electron emitting elements 1 to emit electrons, applying a high voltage to the metal back 6 by way of the high voltage terminal Hv to accelerate the emitted electron beams and bombarding the electrons to the fluorescent film 5 to excite and glow the fluorescent substances. The application voltage Va to the high voltage terminal Hv was set at 1 kV to 5 kV, and the application voltage Vf to across the element electrodes 14 and 15 was set at 14 V.

Glowing spots including those which were formed by electrons emitted from the electron emitting elements 1 disposed at locations near the spacer were formed at equal intervals in two dimensions, thereby allowing a clear image to be displayed with a high reproducibility. This fact indicated that the spacer 10 did not cause such a disturbance as to produce influences on orbits of the electrons and that the spacer 10 was not electrified. The material had a thermal coefficient of resistance of −0.5% and allowed the thermal runaway to occur even at Va=5 kV.

The electrification preventive film 10*c* of the spacer 10 had a resistance value of $1.1\times10^9$ Ω before it was assembled, $1.0\times10^9$ Ω after it was sealed to the pace plate 7 and the rear plate 2, and $1.3\times10^9$ Ω after the evacuation, and $1.4\times10^9$ Ω after energization forming the element electrodes. This indicated that the nitride film of the alloy of Cr, Al and Ge was remarkably stable and suited as an electrification preventive film.

Furthermore, XPS (X-ray photoelectron spectroscopy) of a surface which was conducted on the spacer 10 in its disassembled condition indicated that Cr and Ge were in the form of oxides, whereas aluminium nitride and aluminium oxide were mixed on the surface at a ratio of the nitride ([atomic concentration of nitrogen composing aluminium nitride]/[atomic concentration of aluminium]) of 51 to 55%.

Comparative Example

In a comparative example wherein $SnO_2$ was used in place of the nitride film of the alloy of Cr, Al and Ge on the conductive film 10*c*, its resistance value was remarkably varied at the assembling steps. After completing all the assembling steps, specific resistance was 9.5 Ωm and a resistance value was $4.1\times10^6$ Ω, thereby making it impossible to enhance the application voltage Va to 1 kV. That is, resistance was remarkably changed at inconstant rates at a step to manufacture a display, whereby resistance was remarkably variable and could not be controlled precisely after completing the assembling steps. The specific resistance value of $SnO_2$ obliges to a nitride film to be configured to have an extremely small thickness not larger than 1 nm, thereby making it more difficult to control resistance.

The film was formed by sputtering a target of $SnO_2$ in a mixture atmosphere of oxygen and argon using the sputtering system adopted in the first embodiment. Speaking in detail, sputtering conditions were:

Ar 0.8 mTorr/$O_2$ 0.2 mTorr, $SnO_2$=100 W, substrate grounded at room temperature. The film had a thickness of 2.2 nm. Resistance values were $2.7\times10^9$ Ω before the spacer was assembled, $4.4\times10^5$ Ω after it was sealed to the face plate and the rear plate and $1.8\times10^6$ Ω after it was evacuated and $4.1\times10^6$ Ω after the element electrodes were electroformed.

Eighth Embodiment

Different from the seventh embodiment, the eighth embodiment used a nitride film of an alloy of Ta, Al and Ge in place of the nitride film 10*c* of Cr, Al and Ge of the spacer 10. Like the nitride film used in the seventh embodiment, the nitride film of the eighth embodiment was formed in gas pressure and power conditions: Ar=2.4 mTorr/$N_2$=0.6 mTorr, Ta=200 W, Al=500 W and Ge=50 W. The nitride film 10*c* of the alloy of Ta, Al and Ge had a thickness of approximately 230 nm and specific resistance of $5.2\times10^3$ Ω. Furthermore, the nitride film had a thermal coefficient of resistance of −0.3%, a Ta/(Al+Ge) composition ratio of 41 at. % (atomic %) and a Ge/Al composition ratio of 26 at. % (atomic ratio).

Using the spacer 10 described above, an image forming system was manufactured and evaluated as in the first embodiment.

The application voltage Va to the high voltage terminal Hv was set at 1 kV to 5 kV, and the application voltage vf across the element electrodes 14 and 15 was set at 14 V.

Resistance values which were measured at steps before assembling the spacer, after sealing it to the face plate, after sealing it to the rear plate, after evacuating it and after energization forming the element electrodes were substantially free from variations. Speaking concretely, the resistance values were $2.1\times10^9$ Ω before assembling the spacer, $1.6\times10^9$ Ω after sealing it to the face plate and the rear plate, $2.3\times10^9$ Ω after evacuating it and $2.5\times10^9$ Ω after energization forming the element electrodes.

Furthermore, measurements of resistance values of minute portions of the spacer 10 from the vicinities of the rear plate 2 to the vicinities of the face plate 7 indicated no local variation and the nitride film has a uniform resistance value as a whole.

Glowing spots including those which are formed by electrons emitted from the electron emitting elements 1 disposed at locations near the spacer 10 were formed in rows at equal intervals in two dimensions, thereby allowing a clear color image to be displayed with a high reproducibility. This fact indicated that the spacer 10 did not cause such a disturbance as to produce influences on orbits of the electrons and that the spacer 10 was not electrified.

Furthermore, XPS (X-ray photoelectron spectroscopy) of a surface which was conducted on the spacer in its disassembled condition indicated that Ta and Ge were oxides, whereas aluminium nitride and aluminium oxide were mixed on the surface at a ratio of the nitride ([atomic concentration of nitrogen composing aluminium nitride]/[atomic concentration of aluminium]) of 53 to 57%.

Ninth Embodiment

The ninth embodiment used a nitride film of an alloy of Ti, Al and Ge in place of the nitride film of the alloy of Cr, Al and Ge adopted in the seventh embodiment. Like the nitride film adopted in the seventh embodiment, the nitride film of the ninth embodiment was formed in conditions:

Ar=2.4 mTorr/$N_2$=0.6 mTorr, Ti=120 W, Al=400 W and Ge=100 W (RF). The nitride film of the alloy of Ti, Al and Ge had a thickness of approximately 190 nm and specific resistance of $4.7\times10^3$ Ωm. It had a thermal coefficient of resistance of −0.5%, a Ti/(Al+Ge) composition ratio of 31 at. % (atomic %) and a Ge/Al composition ratio of 63 at. % (atomic %).

Using the spacer described above, an image forming system was manufactured and evaluated as in the first embodiment.

The application voltage Va to the high voltage terminal Hv was set at 1 kV to 5 kv, and the application voltage across the element electrodes 14 and 15 was set at 14 V.

Resistance values which were measured before assembling the spacer, after sealing it to the face plate, after sealing it to the rear plate, after evacuating it and after energization forming the element electrodes remained substantially unchanged throughout all the assembling steps. The resistance values were $2.4\times10^9$ before assembling the spacer, $1.9\times10^9$ Ω after sealing it to the face plate and the rear plate, $2.5\times10^9$ Ω after evacuating it, and $2.7\times10^9$ Ω after energization forming the element electrodes.

Furthermore, measurements of resistance values of minute portions of the spacer 10 from the vicinities of the rear plate to the vicinities of the face plate indicated no locational variation and the nitride film had a uniform resistance value as a whole even after completing all the assembling steps.

Glowing spots including those which were formed by electrons emitted from the electron emitting elements 1 disposed at locations near the spacer 10 were formed in rows at equal intervals in two dimensions, thereby allowing a clear color image to be displayed with a high reproducibility. This fact indicated that the spacer 10 did not cause such a disturbance as to produced influences on orbits of the electrons and that the spacer 10 was not electrified.

Furthermore, XPS (X-ray photoelectron spectroscopy) of a surface which was conducted on the spacer in its disassembled condition indicated that Ti and Ge were oxides, whereas aluminium nitride and aluminium oxide were mixed on the surface at a ratio of the nitride ([atomic concentration of nitrogen composing aluminium nitride]/[atomic concentration of aluminium]) of 49 to 54%.

Tenth Embodiment

The tenth embodiment used a nitride film of an alloy of Mo, Al and Ge in place of the nitride film of the alloy of Cr, Al and Ge which was adopted in the seventh embodiment. Like the nitride film adopted in the seventh embodiment, the nitride film used in the tenth embodiment was formed in conditions:

Ar=2.4 mTorr/$N_2$=0.6 mTorr, Mo=10 W, Al=500 W and Ge=25 W (RF). The nitride film of the alloy of Mo, Al and Ge 10*c* had a thickness of approximately 250 nm and specific resistance of $5.3\times10^3$ Ωm. Furthermore, it had a thermal coefficient of resistance of −0.3%. and Mo/(Al+Ge) composition ratio of 6 at. % (atomic %) and a Ge/Al composition ratio of 13 at. % (atomic %).

Using the spacer 10 described above, an image forming system was manufactured and evaluated as in the seventh embodiment.

The application voltage Va to the high voltage terminal Hv was set at 1 kV to 5 kV, and the application voltage across the element electrodes 14 and 15 was set at 14 V.

Resistance values which were measured at steps before assembling the spacer, after sealing it to the face plate, after sealing it to the rear plate, after evacuating it and after energization forming the element electrodes remained substantially unchanged throughout all the steps. Speaking concretely, the resistance values were $2.0\times10^9$ Ω before assembling the spacer, $1.4\times10^9$ Ω after sealing it to the face plate and the rear plate, $1.9\times10^9$ Ω after evacuating it, and $2.4\times10^9$ Ω after energization forming the element electrodes.

Furthermore, measurements of resistance values of minute portions of the spacer 10 from the vicinities of the rear plate to the vicinities of the face plate indicated no local variations and the nitride film has a uniform resistance value as a whole even after completing all the assembling steps.

Glowing spots including those which were formed by electrons emitted from the electron emitting elements 1 disposed at locations near the spacer 10 were formed in rows at equal intervals in two dimensions, thereby allowing a clear color image to be displayed with a high color reproducibility. This fact indicated that the spacer 10 did not cause such a disturbance as to produce influences on orbits of the electrons and that the spacer 10 was not electrified.

Furthermore, XPS (X-ray photoelectron spectroscopy) of a surface which was conducted on the spacer in its disassembled condition indicated that Mo and Ge were oxides, whereas aluminium nitride and aluminium oxide were mixed on the surface at a ratio of the nitride ([atomic concentration of nitrogen composing aluminium nitride]/[atomic concentration of aluminium]) of 56 to 61%.

Eleventh Embodiment

The eleventh embodiment used a nitride film of an alloy of W, Al and Ge in place of the nitride film of the alloy of Cr, Al and Ge adopted in the seventh embodiment. Like the nitride film adopted in the seventh embodiment, the nitride film used in the eleventh embodiment was formed in conditions:

Ar=2.4 mTorr/$N_2$=0.6 mTorr, W=18 W, Al=200 W and Ge=200 W (RF).

The nitride film of the alloy of W, Al and Ge 10*c* had a thickness of approximately 210 nm and specific resistance of $6.2\times10^3$ Ωm. Furthermore, it had a thermal coefficient of resistance of −0.5%, a W/(Al+Ge) composition ratio of m11 at. % (atomic %) and a Ge/Al composition ratio of 180 at. % (atomic %).

Using the spacer 10 described above, an image forming system was manufactured and evaluated as in the seventh embodiment The application voltage Va to the high voltage terminal Hv was set at 1 kV to 5 kV, and the application voltage Vf across the element electrodes 14 and 15 was set at 14 V.

Resistance values which were measured at steps before assembling the spacer, after sealing it to the face plate, after sealing it to the rear plate, after evacuating it and after energization forming the element electrodes remained substantially unchanged through out the assembling steps. The resistance values were $2.8\times10^9$ Ω before assembling the spacer, $2.2\times10^9$ Ω after sealing it to the face plate and the rear plate, $2.9\times10^9$ Ω after evacuating it, and $3.4\times10^9$ Ω after energization forming the element electrodes.

Furthermore, measurements of resistance values of minute portions of the spacer 10 from the vicinities of the rear plate to the vicinities of the face plate indicated no locational variation and the nitride film had a uniform resistance value as a whole even after completing all the assembling steps.

Glowing spots including those which were formed by electrons emitted from the electron emitting elements 1 disposed at locations near the spacer 10 were formed in rows at equal intervals in two dimensions, thereby allowing a clear color image to be reproduced with a high color reproducibility.

This high color reproducibility indicates that the spacer 10 did not cause such a disturbance as to produce influences on orbits of the electrons and that the spacer 10 was not electrified.

Furthermore, XPS (X-ray photoelectron spectroscopy) of a surface which was conducted on the spacer in its disassembled condition indicated that W and Ge were in the form of oxides, whereas aluminium nitride and aluminium oxide were mixed on the surface at a ratio of ([atomic concentration of nitrogen composing aluminium nitride]/[atomic concentration of aluminium]) of 58 to 62%.

As understood from the foregoing description even a nitride film which contains aluminium has resistance varied little at manufacturing steps and may not be configured as an extremely thin film or in an island-like pattern even when it has high resistance, thereby featuring excellent stability and reproducibility. This nitride film also has a high melting point and high hardness, thereby exhibiting a merit of high stability. The nitride film can have an optional resistance value by adjusting its composition since aluminium nitride and germanium nitride are insulating materials, whereas transition metals are good conductors. The electrification preventive film according to the present invention is applicable not only to the image forming systems preferred as the embodiments described above but also to CRTs and electronic tubes such as discharge tubes and is widely usable in fields wherein electrification is problematic.

Furthermore, the image forming system according to the present invention, which uses a nitride film of an alloy of aluminium, germanium and a transition metal as an electrification preventive film on a surface of an insulating member disposed between an element substrate and a face plate, allows resistance to be varied at assembling steps and provides a stable resistance value. Accordingly, the image forming system according to the present invention is capable of suppressing disturbance of electron beams in the vicinities of a spacer, preventing locations of fluorescent substances bombarded with electron beams from deviating from locations of the fluorescent substances which are originally to be glowed and reducing a luminance loss, thereby allowing clear images to be displayed.

When a nitride film of aluminium, germanium and a transition metal is used as an electrification preventive film, it is capable of suppressing electrification more effectively as its surface has a higher nitrization ratio of aluminium ([atomic concentration of nitrogen composing aluminium nitride]/atomic concentration of aluminium]), which can be 35% or higher even when the nitride film is sealed in atmosphere.

Twelfth Embodiment

Though the embodiments described above are configured to use germanium nitrides which contain transition metals, the present invention is not limited by the germanium nitrides but can use other germanium compounds. The twelfth embodiment uses a germanium oxide. Furthermore, the twelfth embodiment uses a film of a germanium compound (a second layer) and a film (a first layer) which contains a metal, a transition metal in particular which are laminated. It is preferable to use an oxide as the first layer and to select iron, cobalt, copper or ruthenium as the transition metal. Speaking more concretely, it is preferable to use iron oxide, cobalt oxide, copper oxide, ruthenium oxide or a mixture thereof and another transition metal as the first layer. From a viewpoint for preferable control of a thermal coefficient of resistance, it is preferable to select from among iron oxide, cobalt oxide, copper oxide, ruthenium oxide and a mixture thereof and chromium oxide, zirconium oxide, niobium oxide, hafnium oxide, tantalum oxide, tungsten oxide, ruthenium oxide or yttrium oxide.

By adopting such a laminated structure which comprises a first layer to control conductivity in combination with a layer of a germanium compound in particular, it is possible to obtain a preferable electrification suppressing structure within a wide range of specifications for germanium compounds.

The twelfth embodiment is configured to allow the films as the first layer and the second layer to be formed on an insulating member in particular, not only by the vacuum deposition method, the sputtering method or the CVD method but also by a simple film forming method such as a dipping method, a spinner method, a spraying method or a potting method Desired electrification moderating films can be formed, for example, by mixing, applying, drying and calcinating at 400° C. to 1000° C. dispersions of fine particles of metal oxides, preferably fine particles not larger than 200 microns, or sol solutions of metallic alcoxide, organic metal salts and derivatives thereof dependently on purposes. When importance is placed on stabilities of the solutions, it is not preferable to mix metallic alcoxide with an organic metal salt.

A configuration of a spacer used in the twelfth embodiment will be described in detail.

A layer of a mixture of yttrium oxide and copper oxide was formed as the first layer (by the dipping method) and a layer of germanium oxide was formed as the second layer (by the spraying method) to form an electrification preventive film 10*c* on an insulating substrate 10*a* composed of cleaned soda lime glass sheet (2.8 mm high by 200 μm thick by 40 mm long), thereby manufacturing a spacer 10.

The layer of yttrium oxide and copper oxide used in the twelfth embodiment was formed using a mixture of a coating agents SYM-YO1 and SYM-CUO4 offered by High Purity Chemistry Research Institute, Co., Ltd. First, the first layer (100 mm thick) was formed by applying the mixture of YO1 and SYM-$CUO_4$ to the spacer by dipping (raising speed: 2 mm/sec), drying it at 120° C. and calcining it at 450° C., and then the layer of germanium oxide 10 mm thick (SYM-$GEO_3$ used as $GeO_2$) was formed by the spraying method.

The spacer adopted for the twelfth embodiment caused nearly no deviation of glowing spots formed by electrons emitted from the electron emitting elements 1 in the vicinities of the spacer in the driving conditions described above, thereby allowing to display an image which is not problematic as a TV image.

The electrification moderating film formed in the twelfth embodiment had a specific resistance values of $7.2\times10^3$ Ωm after it was formed, $8.5\times10^3$ Ωm after it was assembled, $8.3\times10^3$ Ωm after it was evacuated, and a thermal coefficient of resistance of −0.6%.

As understood from the foregoing description, it is possible by using a germanium compound to obtain an electrification moderating film which can hardly be electrified or is liable to be less electrified. Furthermore, use of a germanium compound makes it possible to obtain a film which has a preferable reproducibility. Furthermore, use of a germanium compound makes it possible to obtain a film having high stability. Accordingly, use of a germanium compound makes it possible to configure an electron beam system which is less affected by electrification.

What is claimed is:

1. An electrification moderating film comprising a nitrogen compound of germanium and a transition metal.

2. The electrification moderating film according to claim 1, wherein said transition metal is at least one of chromium, titanium, tantalum, molybdenum and tungsten.

3. The electrification moderating film according to claim 1, wherein said nitrogen compound of germanium further comprises aluminum.

4. The electrification moderating film according to claim 3, wherein said transition metal is at least one of chromium, titanium, tantalum, molybdenum and tungsten.

5. An electrification moderating film comprising a nitrogen compound of germanium and a transition metal, wherein said electrification moderating film has a nitrization ratio of germanium not lower than 50%.

6. The electrification moderating film according to claim 1, wherein said compound of germanium is a compound of nitrogen which contains a transition metal, aluminum and germanium, and said electrification moderating film has a nitrization ratio of an aluminum surface not lower than 35%.

7. An electrification moderating film comprising at least a compound of germanium and further comprising a second layer which contains said compound of germanium and a first layer which contains at least a metal.

8. The electrification moderating film according to claim 7, wherein said first layer and said second layer are laminated.

9. The electrification moderating film according to claim 7, wherein said metal is a transition metal.

10. The electrification moderating film according to claim 7, wherein said metal is at least one of iron, cobalt, copper and ruthenium.

11. The electrification moderating film according to claim 7, wherein said first layer contains at least an oxide of said metal.

12. The electrification moderating film according to claim 7, wherein said first layer contains at least one of iron oxide, cobalt oxide, copper oxide and ruthenium oxide.

13. An electrification moderating film comprising at least a compound of germanium, wherein said compound of germanium is a nitrogen compound of germanium and a layer which contains at least said nitrogen compound of germanium has a thickness not smaller than 10 nm and not larger than 1 μm.

14. The electrification moderating film according to claim 1, wherein said film has a thickness not smaller than 1 nm and not larger than 1 μm.

15. An electrification moderating film comprising a nitrogen compound of germanium and aluminum, wherein a layer which contains at least the nitrogen compound and aluminum has a thickness not smaller than 10 nm and not larger than 1 μm.

16. The electrification moderating film according to claim 1, wherein said nitrogen compound of germanium comprises the transition metal, aluminum and germanium, and a layer which contains at least the nitrogen compound containing the transition metal, aluminum and germanium has a thickness not smaller than 10 nm and not larger than 1 μm.

17. The electrification moderating film according to claim 7, wherein said first layer has a thickness not smaller than 10 nm and not larger than 1 μm.

18. The electrification moderating film according to claim 7, wherein said second layer has a thickness not smaller than 5 nm and not larger than 30 nm.

19. The electrification moderating film according to claim 1, wherein a layer which contains at least said compound of germanium has a thermal coefficient resistance not higher than 1% in absolute.

20. The electrification moderating film according to claim 19, wherein said thermal coefficient of resistance is negative.

21. An electrification moderating film comprising at least a compound of germanium, wherein said compound of germanium is a nitrogen compound of germanium and a layer which contains at least said nitrogen compound of germanium has a thermal coefficient of resistance not higher than 1% in absolute.

22. The electrification moderating film according to claim 21, wherein said thermal coefficient of resistance is negative.

23. The electrification moderating film according to claim 7, wherein said first layer has a thermal coefficient of resistance not higher than 1% in absolute.

24. The electrification moderating film according to claim 23, wherein said thermal coefficient of resistance is negative.

25. An electron beam system comprising in an enclosure:

an electron source;

an opposed member which is opposed to said electron source; and a first member which is disposed between said electron source and said opposed member, wherein said first member comprises a substrate and the electrification moderating film as claimed in any one of claims 1, 5, 7, 13, 15, and 21 provided on said substrate.

26. The electron beam system according to claim 25, wherein said substrate has an insulating property.

27. The electron beam system according to claim 25, wherein said first member is a spacer which maintains a gap between said electron source and said opposed member.

28. The electron beam system according to claim 25, wherein said electrification moderating film has specific resistance not lower than $10^{-3}\times$Va Ωm and not higher than $10^5$ Ωm when a voltage applied across an end of said first member on a side of said electron source and another end of said first member on a side of said opposed member is represented by Va.

29. An electron beam system comprising in an enclosure:

an electron source;

an opposed member which is opposed to said electron source; and a first member which is disposed between said electron source and said opposed member, wherein said first member comprises a substrate and an electrification moderating film comprising at least a compound of germanium provided on said substrate, and said substrate contains Na, and an Na blocking layer is disposed between said substrate and said electrification moderating film.

30. An electron beam system comprising in an enclosure:

an electron source;

an opposed member which is opposed to said electron source; and a first member which is disposed between said electron source and said opposed member, wherein said first member comprises a substrate and an electrification moderating film comprising at least a compound of germanium provided on said substrate, and said electron beam system further comprises at least any one of a layer of silicon oxide, a layer of zirconium oxide and a layer of aluminum oxide between said substrate and said electrification moderating film.

31. The electron beam system according to claim 25, wherein said electron source has cold-cathode type electron emitting elements.

32. The electron beam system according to claim 25, wherein said electron source has surface conduction type electron emitting elements.

33. An image forming system comprising in an enclosure:

an electron source;

an image forming member which is disposed in opposition to said electron source and forms an image when irradiated with electrons; and a first member which is disposed between said electron source and said image forming member, wherein said first member comprises a substrate and the electrification moderating film as claimed in any one of claims 1, 5, 7, 13, 15, and 21 provided on said substrate.

34. The image forming system according to claim 33, wherein said substrate has an insulating property.

35. The image forming system according to claim 33, wherein said first member is a spacer which maintains a gap between said electron source and said image forming member.

36. The image forming system according to claim 33, wherein said electrification moderating film has specific resistance not lower than $10^{-7}\times Va$ Ωm and not higher than $10^{5}$ Ωm when a voltage applied across an end of said first member on a side of said electron source and another end of said first member on a side of said image forming member is represented by Va.

37. The image forming system according to claim 33, wherein said first member is connected to an electrode disposed in said enclosure.

38. The image forming system according to claim 33, wherein said first member is connected to a plurality of electrodes which are disposed in said enclosure and kept at different potentials.

39. The image forming system according to claim 37, wherein said first member has an electrode which is located at an end to be connected to said electrode disposed in enclosure and disposed along said end.

40. The image forming system according to claim 33, wherein said first member is connected to an electrode disposed on said electron source and an electrode disposed on said image forming member.

41. The image forming system according to claim 40, wherein the electrode disposed on said electron source is kept at a potential to drive the electron emitting elements of said electron source.

42. The image forming system according to claim 40, wherein the electrode disposed on said image forming member is kept at a potential to accelerate electrons emitted from said electron source.

43. An image forming system comprising in an enclosure:

an electron source;

an image forming member which is disposed in opposition to said electron source and forms an image when irradiated with electrons; and a first member which is disposed between said electron source and said image forming member, wherein said first member comprises a substrate and an electrification moderating film comprising at least a compound of germanium provided on said substrate, and said substrate contains Na, and an Na blocking layer is disposed between said substrate and said electrification moderating film.

44. An image forming system comprising in an enclosure:

an electron source;

an image forming member which is disposed in opposition to said electron source and forms an image when irradiated with electrons; and a first member which is disposed between said electron source and said image forming member, characterized in that said first member comprises a substrate and the electrification moderating film comprising at least a compound of germanium provided on said substrate, and said image forming system comprises at least any one of a layer of silicon oxide, a layer of zirconium oxide and a layer of aluminum oxide between said substrate and said electrification moderating film.

45. The image forming system according to claim 33, wherein said electron source comprises cold-cathode type electron emitting elements.

46. The image forming system according to claim 33, wherein said electron source comprises surface conduction type electron emitting elements.

47. A member comprising:

a substrate; and an electrification moderating film disposed on said substrate, wherein said electrification moderating film is the electrification moderating film as claimed in any one of claims 1, 5, 7, 13, 15, and 21.

48. The electrification moderating film according to claim 1, wherein said transition metal is contained in said film as a transition metal nitride.

* * * * *

UNITED STATES PATENT AND TRADEMARK OFFICE

CERTIFICATE OF CORRECTION

PATENT NO. : 6,777,868 B1
DATED : August 17, 2004
INVENTOR(S) : Yoko Kosaka et al.

It is certified that error appears in the above-identified patent and that said Letters Patent is hereby corrected as shown below:

Title page,
Item [56], References Cited, FOREIGN PATENT DOCUMENTS, "98080945" should read -- 98-80945 --.

Column 4,
Line 57, "fist" should read -- first --.

Column 6,
Line 47, "at" should read -- to --.

Column 7,
Line 15, "produced" should read -- produce's --; and
Line 27, "if" should read -- it --.

Column 9,
Line 6, "oxide" should read -- oxidate --;
Line 12, "on" should be deleted;
Line 26, "oxided" should read -- oxidated --; and
Line 55, "Pys." should read -- Phys. --.

Column 10,
Line 5, "Advance" should read -- Advances --;
Line 6, ""PHYSICAL" should read -- "Physical --;
Line 11, "32,646" should read -- Vol. 32, No. 4, p. 646 --; and
Line 52, "like" should read -- like. --.

Column 13,
Line 53, "niques" should read -- nique --.

Column 15,
Line 65, "have" should read -- has --.

Column 16,
Line 34, "contain" should read -- contains --.

Column 21,
Lines 60 and 64, "While," should read -- While --.

UNITED STATES PATENT AND TRADEMARK OFFICE

CERTIFICATE OF CORRECTION

PATENT NO. : 6,777,868 B1
DATED : August 17, 2004
INVENTOR(S) : Yoko Kosaka et al.

It is certified that error appears in the above-identified patent and that said Letters Patent is hereby corrected as shown below:

Column 23,
Line 32, “1 w” should read -- 1 W --.

Column 27,
Line 26, “son” should read -- so --.

Column 30,
Line 17, “Ar 0.8” should read -- Ar = 0.8 --.

Column 32,
Line 5, “-0.3%.” should read -- -0.3%, --;
Line 59, “mll” should read -- mol --; and
Line 64, “embodiment” should read -- embodiment. --.

Column 35,
Line 66, “1 nm” should read -- 10 nm --.

Signed and Sealed this

Thirteenth Day of September, 2005

JON W. DUDAS
*Director of the United States Patent and Trademark Office*